US008967066B1

(12) United States Patent
Bekey

(10) Patent No.: US 8,967,066 B1
(45) Date of Patent: Mar. 3, 2015

(54) AUTOMATIC DOCKING LINE MANAGEMENT SYSTEM

(76) Inventor: Ivan Bekey, Annandale, VA (US)

( * ) Notice: Subject to any disclaimer, the term of this patent is extended or adjusted under 35 U.S.C. 154(b) by 31 days.

(21) Appl. No.: 13/506,439

(22) Filed: Apr. 19, 2012

Related U.S. Application Data

(60) Provisional application No. 61/476,860, filed on Apr. 19, 2011.

(51) Int. Cl.
*B63B 21/00* (2006.01)

(52) U.S. Cl.
CPC ..... *B63B 21/00* (2013.01)
USPC ..... 114/230.24; 114/230.23; 267/69

(58) Field of Classification Search
CPC ..... B63B 21/00; B63B 22/00; B63B 22/02; B63B 27/00; B63B 27/18
USPC ..... 114/230.21, 230.22, 230.23, 230.24, 114/230.25, 293; 141/98, 279; 267/69, 73, 267/74
See application file for complete search history.

(56) References Cited

U.S. PATENT DOCUMENTS

| | | | | |
|---|---|---|---|---|
| 2,942,740 | A * | 6/1960 | Pristach | 414/138.4 |
| 3,727,650 | A * | 4/1973 | Ingram et al. | 141/98 |
| 4,022,450 | A * | 5/1977 | Smith, Jr. | 267/73 |
| 4,809,635 | A * | 3/1989 | Essig | 114/230.23 |

* cited by examiner

*Primary Examiner* — Lars A Olson

(57) ABSTRACT

An apparatus and method for use on aquatic vessels for automatically retracting a docking line released from the vessel when undocking so that it is stored out of the water next to a fixed structure such as a piling, initiated with one simple manual operation; and extending the line when docking the vessel by engaging said line and attaching it to the vessel, also all with one simple manual operation. The means for generating the retraction forces acting on the docking line can be a spring-actuated reel mounted on the fixed structure, causing tension in a thin retrieving line attached to the docking line. Alternatively the forces can be generated by sets of weighted blocks and pulleys, or elastic cords. Use of the embodiments will avoid undocking stresses of using long boathooks to hang docking lines on pilings, and reaching them when docking; or throwing them.

20 Claims, 12 Drawing Sheets

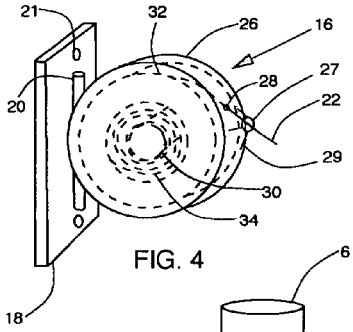
FIG. 4
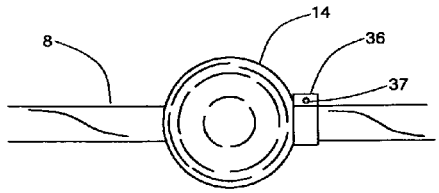
FIG. 5
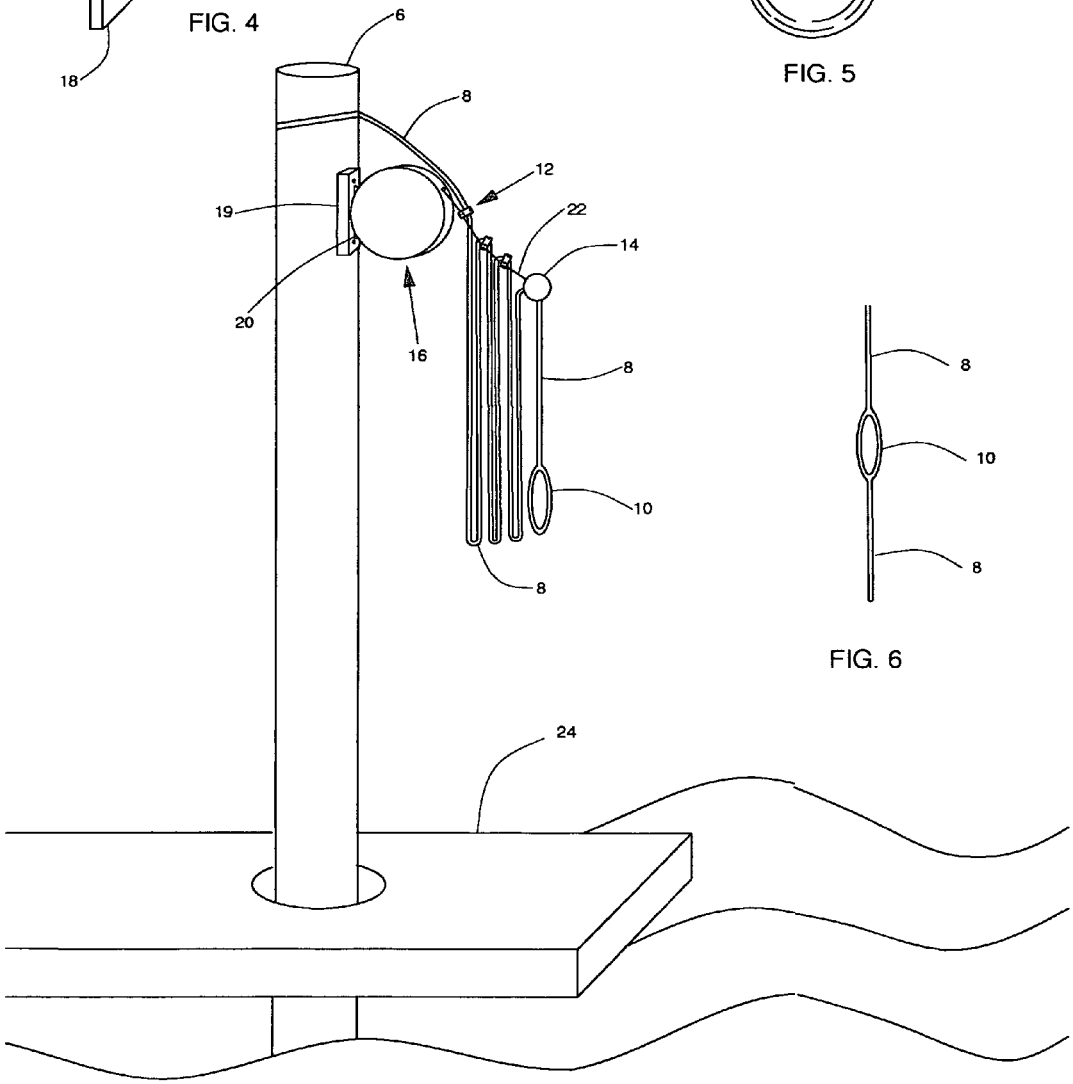
FIG. 3
FIG. 6

AUTOMATIC DOCKING LINE MANAGEMENT SYSTEM

CROSS-REFERENCE TO RELATED APPLICATIONS

This application claims the benefit of PPA 61,476,860 filed on Apr. 19, 2011 by the present inventor.

BACKGROUND

Prior Art

The following is a tabulation of some prior art that presently appears at least partly relevant:

| U.S. patents | | |
|---|---|---|
| U.S. Pat. No. | Issue date | Patentee |
| 3,187,706 | Jun. 8, 1965 | Ross |
| 2,811,127 | Oct. 29, 1957 | Palsson |
| 4,317,421 | Mar. 2, 1982 | Pollack |
| 4,462,329 | Jul. 31, 1984 | Brushaber |
| 4,676,182 | Jun. 30, 1987 | Chaiko |
| 4,809,635 | Mar. 7, 1989 | Essig |
| 6,095,075 | Aug. 1, 2000 | Gordon and Knight |
| 6,845,731 B1 | Jan. 25, 2005 | Anderson |
| 4,470,558 | Sep. 11, 1984 | Stamper |
| 5,813,816 | Sep. 29, 1998 | Lloyd |
| U.S. patent application Publications | | |
| application number | Date | Applicant |
| 2007/0186835 A1 | Aug. 16, 2007 | Livingston |

Search fields: 114/230, 219, 242; 119/794, 795, 796

One of the most frustrating and difficult aspects of operating a boat or vessel, particularly a sail or power-operated pleasure vessel, is the chore of docking and undocking the vessel from a slip or dock. The process of undocking a vessel usually involves untying one or more docking lines which are attached to a piling or other fixed object on the dock or slip, and attaching it to the fixed pile or object in such a way that it is compact, does not hang into the water, does not interfere with other boats or personnel, and does not constitute a safety hazard. (This application will use the nautical term "line" to mean any article commonly caller a "rope" in non-nautical terms). This operation generally requires that the docking line be manually coiled and carefully placed on the dock or on a cleat or hook on a piling by using a long pole known as a boating hook, which allows the usual distance between the vessel and the fixed pile to be overcome, but which is stressful and difficult to operate, and which can cause back strain.

Many boaters opt to simply throw the docking line ashore, either hoping to snag it on a cleat or simply abandoning it on the dock until they return. Many such attempts fail and the docking line falls into the water, where it becomes a hazard for the vessel upon retuning because it could snag its propeller or rudder; and quickly can become covered with marine organisms which discolor the docking line as well as cause it to be slimy or rough. Upon the vessel's returning to the dock or slip the reverse operation must be accomplished including hooking the line with a long boathook whether it lies on a piling or dock or in the water and then pulling said line onto the vessel for making it fast, or asking people on the dock to throw the line aboard, or frequently the vessel operator jumping off the docking vessel to pick up the line and bring it manually onto the vessel.

All of these operations require strength and take up valuable time just when the vessel is in danger of collision with the dock or slip if returning, or collision with pilings or other vessels when leaving. To make matters worse for most recreational boaters there is no professional crew to handle these chores, and the owner, or most often the owners' spouse, is stuck with these chores. It is safe to say that not only are accidents most likely to happen during these maneuvers, but because the operations are stressful because of the danger of damage to the vessel, or to neighboring vessels, it is unfortunately very common for tempers to fray and the pleasure of boating is greatly diminished. While larger vessels are not free from the same operations and problems their professional crew is there to handle them, though the chores are hardly pleasant even then.

It is therefore the objective of these embodiments to make both the docking and undocking operation of pleasure vessels easier, less stressful both physically and mentally, and much safer, so that their operation can indeed be pleasurable as intended.

A number of patents have been granted in the general area of aids to docking line handling, retrieval, and storage. The most pertinent of those found are referenced and discussed to show that they do not address the problem as well as the present embodiments in important distinctions, do not address both docking and undocking, do not teach the same features, and are less effective than these embodiments in meeting the objectives of attaining a safe, simple, non-stressful, and effective means to automatically retrieve, store, and extend vessel docking lines.

The simplest of the patents in the prior art is typified by M. P. Palsson, U.S. Pat. No. 2,811,127, Oct. 29, 1957, which is just an adaptation of a long boat hook to make the placing of a docking line on a piling somewhat easier, but does not address how to engage, store, or retrieve the docking lines, all of which are addressed by the present embodiments.

The same goes for E. M. Livingston, U.S. 2007/0186835 A1, Aug. 16, 2007, which describes an even more complicated boat hook but also does not address how to engage, store, or retrieve the docking lines, all of which are addressed by the present embodiments.

Other approaches to safer docking are typified by J. A. Ross, U.S. Pat. No. 3,187,706, Jun. 8, 1965, which teaches only the setting up of a spring-actuated cushioning line to soften any jarring upon re-docking, but still does not address the docking line retrieval, storage, and deployment.

Another such patent is J. Pollack, U.S. Pat. No. 4,317,421, Mar. 2, 1982, who teaches spring-actuated mechanisms to cushion docking once made, but also does not address how to engage, store, or retrieve the docking lines, all of which are addressed by the present embodiments.

Similarly D. Brushaber, U.S. Pat. No. 4,462,329, Jul. 31, 1984, teaches a means to hold a docking line and to stow it out of the vessel's way, but operations in wind or waves would be difficult and could easily damage the vessel against the protruding long arm. Furthermore Brushaber does not teach using an automatic means to retract or extend the line, all of which are addressed by the present embodiments.

Also similar is W. M. Chaiko, U.S. Pat. No. 4,676,182, Jun. 30, 1987, who describes a means to position docking lines over the water so that they are more accessible to vessels desiring to dock, however it teaches the use of weights and mechanisms permanently outboard of the dock and substantially over the water, which pose a real danger to the vessel which could easily strike them and incur damage. Additionally Chaiko does not teach retracting the docking line and its weights or holders completely out of the way of a vessel, nor deploying it when needed without the aforementioned dangers, all of which are addressed by the present embodiments.

N. E. Essig, U.S. Pat. No. 4,809,635, Mar. 7, 1989, teaches using a spring-actuated reel to retract and store a retraction line outfitted with an end ring at the dock, which obviously requires several prior manual operations to grasp the docking line, also presumed to be on the dock, attach the end of the docking line to the said end ring, and leave both at the dock ready for grappling. When a vessel comes toward the dock or slip for docking the vessel operator must extend a long boathook and grapple said end ring and draw it into the vessel, grasp the ring with one hand, separate the end ring and retrieving line from the attached docking line with the other hand, and attach the separated docking line onto the vessel. Thus a minimum of four manual operations are required just to dock the vessel using Essig's patent. Furthermore Essig does not address the undocking maneuver at all which, were it to be addressed, would require another minimum of four manual operations to retrieve the retrieval line and end ring from the dock, detach the docking line from the vessel, attach the docking line to the retrieval end ring, and them go. Thus not only does Essig not teach any device or method for undocking, his teaching for docking is cumbersome, requires a minimum of four annual operations, and overcomes few of the problems commonly incurred in such maneuvers, all of which are addressed and innovatively overcome by the present embodiments.

Other approaches in prior art include reels for docking lines which are attached to the vessel or the ground under it rather to the dock, including for example L. C. Gordon and D. C. Knight, U.S. Pat. No. 6,095,075, Aug. 1, 2000. This invention does not discuss automatic docking or undocking, nor extension and retrieval of a docking line, least of all with only one manual operation. Neither this nor any other of these approaches address means to extend or affix the line to a dock or piling nor means or procedures for retrieving the attachment when undocking, all of which are the subject of this embodiments.

There is considerable prior art in spring actuated reels for storing lines, many of which were conceived to control animals on leash or lunge, or for deploying clotheslines and storing the lines when no longer needed. Specific examples in 119/794 and 119/795 include U.S. Pat. No. 5,377,626, U.S. Pat. No. 6,845,736, U.S. Pat. No. 4,470,558 and U.S. Pat. No. 5,813,816, all of which teach the particulars of spring-actuated mechanisms but do not address the problem of access to, easy deployment from, and easy retrieval of lines attached to a fixed structure used over the water, and which can only be accessed remotely rather than the continuous hands-on access of these animal control reel operated devices.

In summary a search of prior art has found a field well populated with inventions, but none that teach all the necessary elements or methods of the present embodiments, and none that result in its capabilities, all of which are addressed by the present embodiments and are described below.

SUMMARY

The embodiments describe apparatus and method for reversibly operating a docking line for attaching and detaching an aquatic vessel to a fixed over-water structure. One embodiment comprises a normal docking line, a thin retrieval line permanently attached to the docking line and operated by a spring-actuated reel to retract the docking line when it is manually released from the vessel and store it proximal to the fixed structure out of the way and above the water, all in one operation; and to reverse the operation by manually extending the docking line with thin retrieval line attached and attach it to the vessel in order to dock it, also all in one operation. Alternate embodiments comprise using weighted blocks and pulleys to generate the tension force, or use an elastic cord as the sole means of generating the tension force. The embodiments also comprise varied means to keep the retrieval line proximal to the docking line and preventing snags and kinks, thereby assuring controlled retraction and storage of the docking line.

Advantages

These embodiments, in contrast to current and previous art, will make the handling and storage of docking lines for boats and other aquatic vessels easy, safe, and quick, both when leaving a dock or slip and when returning to it. In particular they will allow the operator when undocking his vessel to detach the docking line from the vessel and simply to let it go, the embodiments proceeding to retrieve the docking line, store it neatly in such manner that all the docking line lies clear of the water and close to a piling or other fixed structure and away from the vessel, and presenting it neatly ready for the next docking opportunity, all in one easy manual operation. It will also enable an operator when docking the vessel to grasp the end of the docking line which will be available, presented, and ready for use as stored, pull it onto the vessel and attach it there, likewise all in one easy manual operation, which will automatically cause the embodiments to be in the identical configuration as they were at the beginning of the undocking operation without any extra operations. When several such embodiments are used in several directions from several pilings or docks to the vessel the constant tension from the docking lines will also maintain the vessel substantially centered in the slip in the presence of variable winds and tides. This simplicity, safety, and convenience of operation are not anticipated in prior art found, nor are they available in any product on the market.

BRIEF DESCRIPTION OF ALL THE DRAWINGS

FIG. 1 illustrates the extended, or docked configuration of the currently preferred embodiment FIG. 2 illustrates the retracted, or undocked configuration of the currently preferred embodiment FIG. 3 is a larger drawing otherwise similar to FIG. 2, positioned over a floating dock FIG. 4 illustrates one of many possible spring actuated reel line retractors FIG. 5 illustrates a spherical line stopper and its means of attachment to a docking line FIG. 6 illustrates the end of a docking line in which a loop is formed near to but not at its end FIG. 7 shows an attachment fitting clamped on a docking line and accommodating a retrieval line FIGS. 8A-8C are views of two alternate configurations of the attachment fitting of FIG. 7

Figure 22:
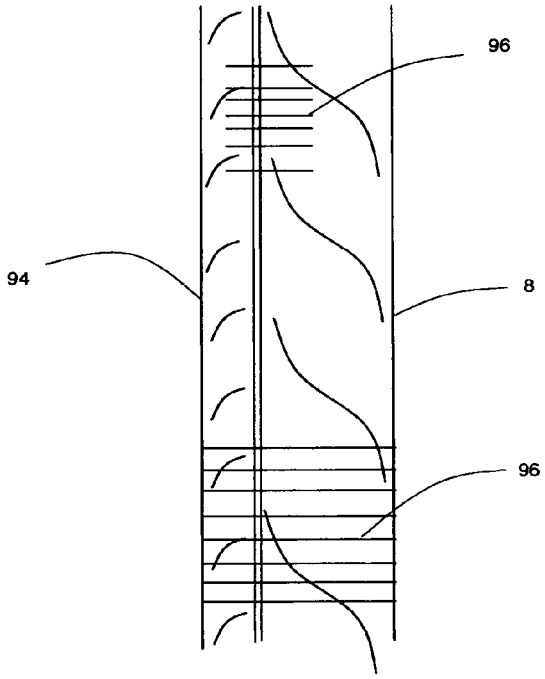
Figure 23:
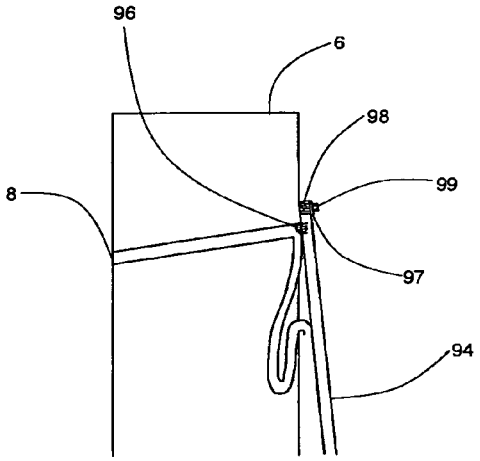
Figure 24:
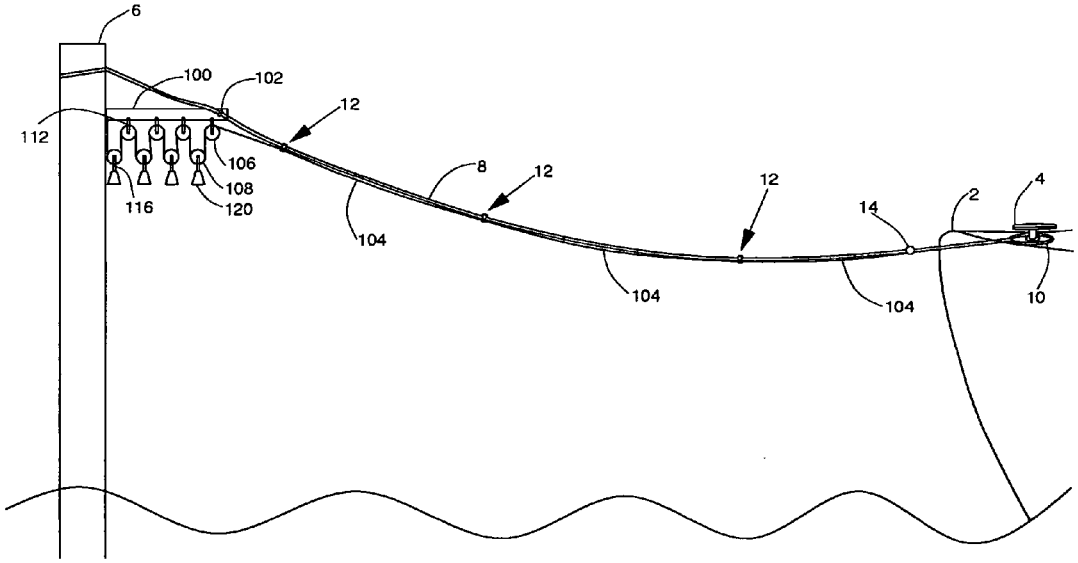
Figure 25:
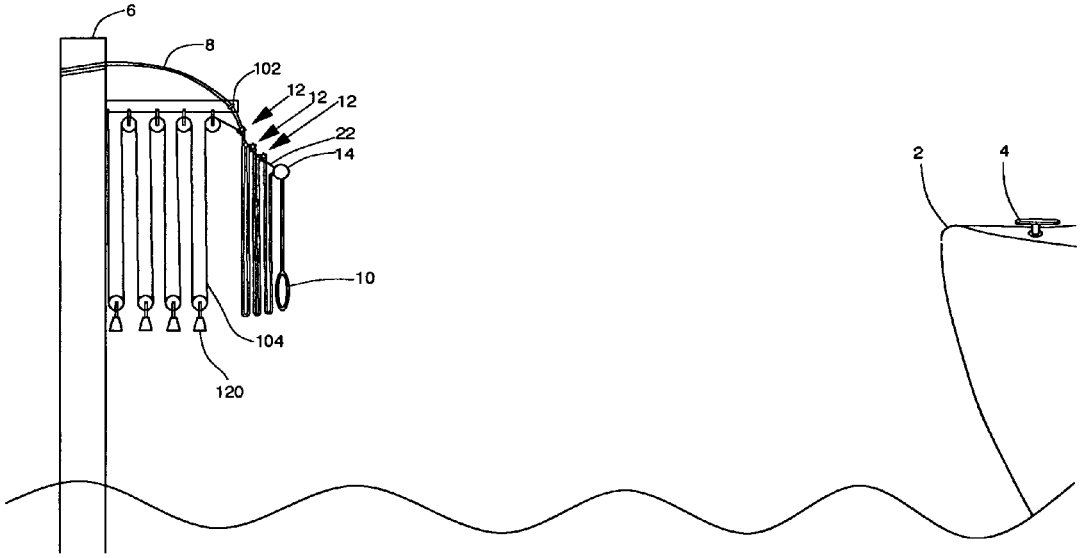
Figure 26:
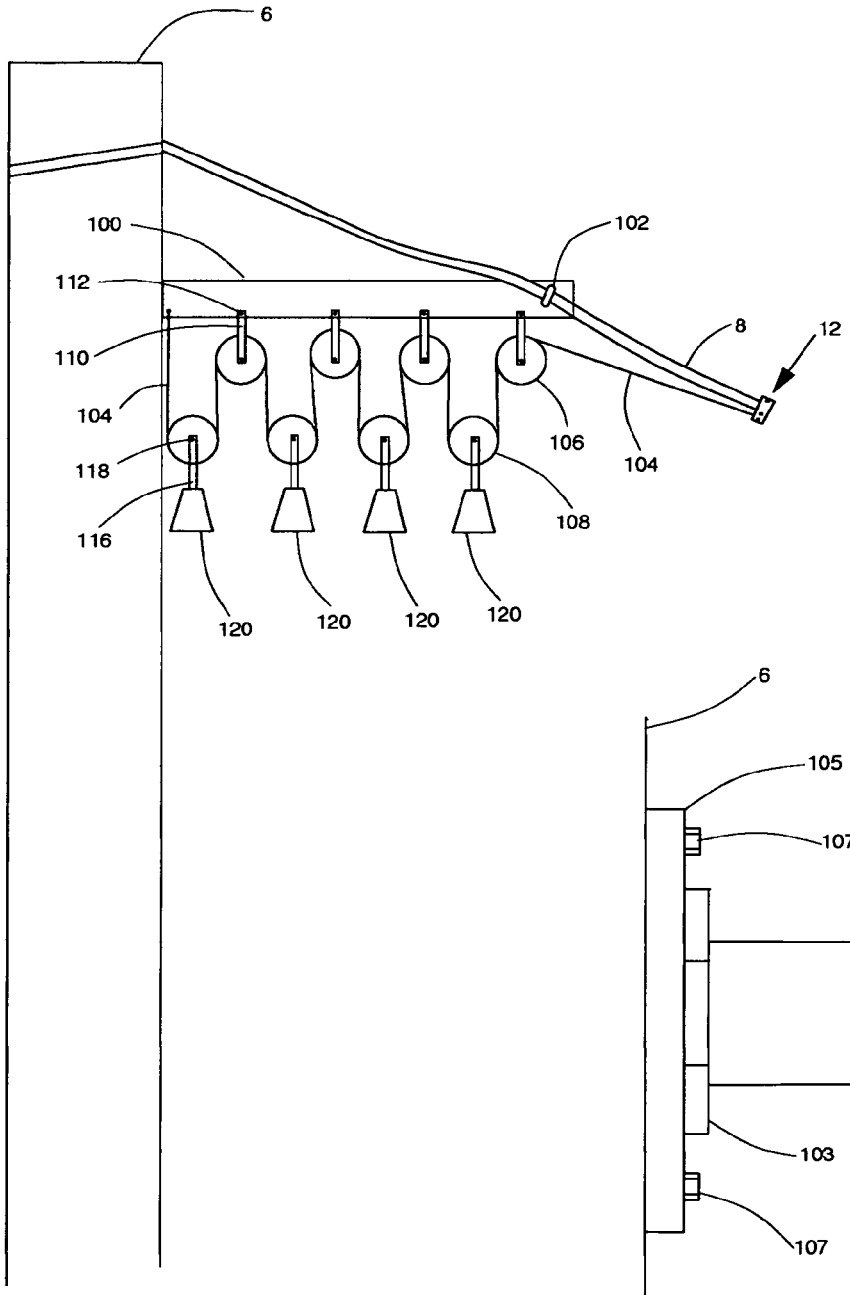

FIG. 22 shows ligatures or threads attaching the bungee cord and docking line of the 2nd alternate embodiment FIG. 23 illustrates one way to attach the bungee of the second alternate embodiment to a piling FIG. 24 illustrates the extended, or docked configuration of the third alternate embodiment FIG. 25 illustrates the retracted, or undocked configuration of the third alternate embodiment FIG. 26 is a larger drawing otherwise the same as FIG. 25

Figure 27:
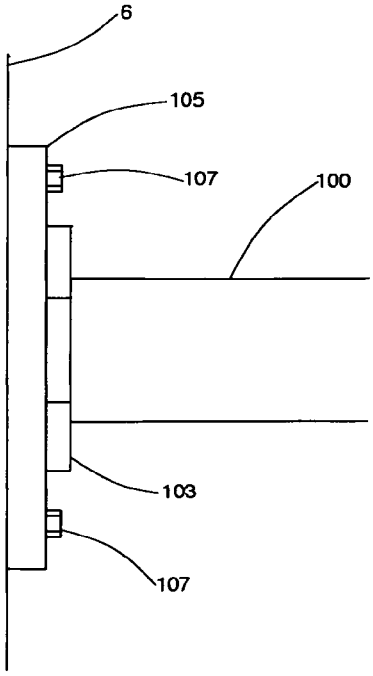
Figure 28:
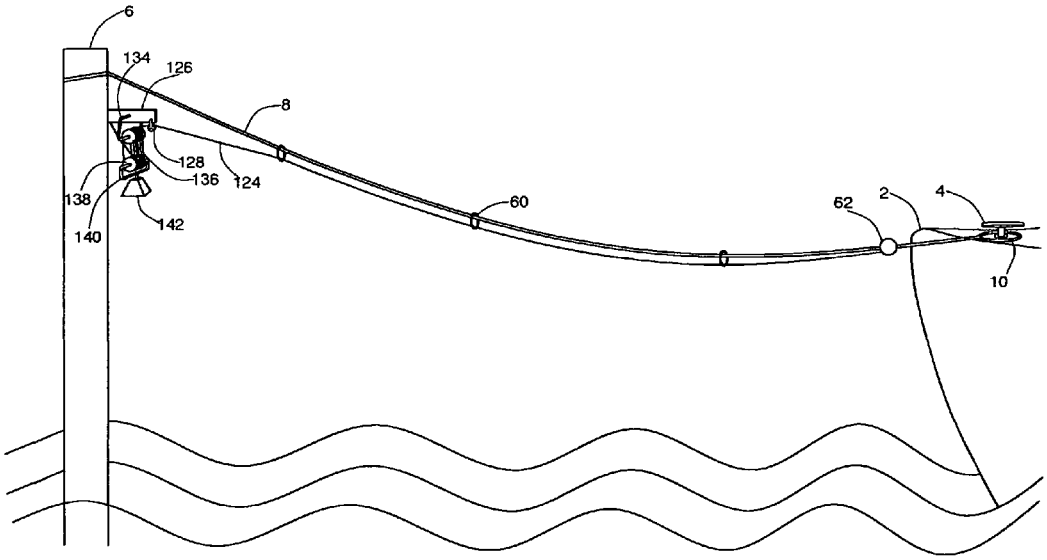
Figure 29:
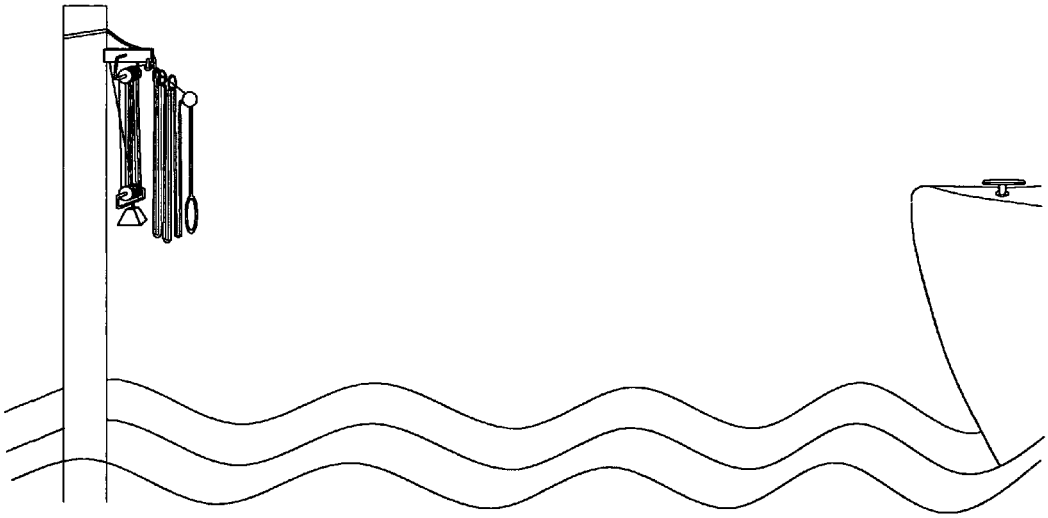
Figures 30, 31:
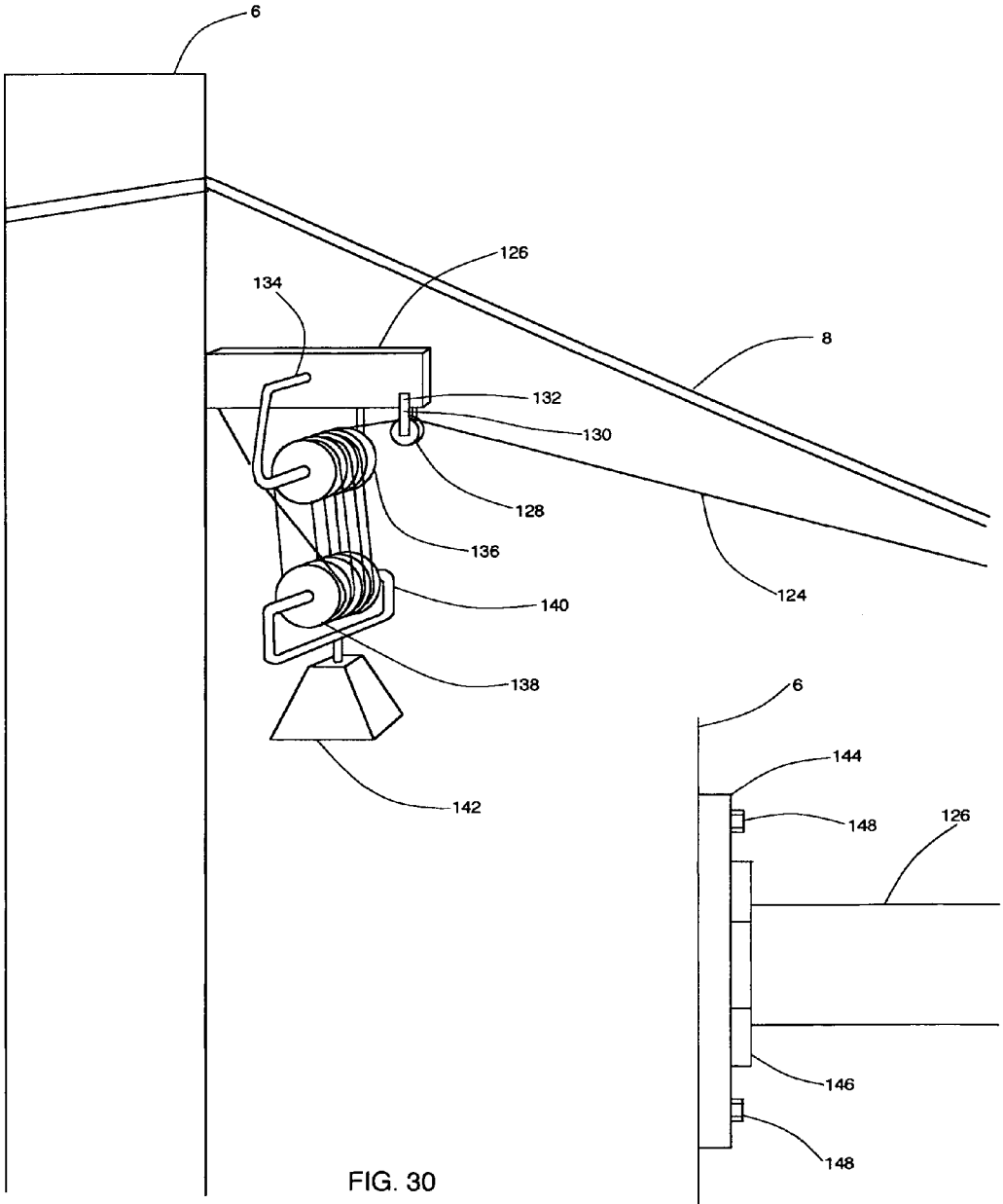

FIG. 27 illustrates an alternate means of attaching the frame of FIG. 26 to a piling FIG. 28 illustrates the extended, or docked configuration of the fourth alternate embodiment FIG. 29 illustrates the retracted, or undocked configuration of the fourth alternate embodiment FIG. 30 is a larger drawing otherwise the same as FIG. 29

FIG. 31 illustrates an alternate means of attaching the frame of FIG. 30 to a piling

DETAILED DESCRIPTION OF THE CURRENTLY PREFERRED EMBODIMENT

FIGS. 1 through 9C apply to the currently preferred embodiment

Figure 1:
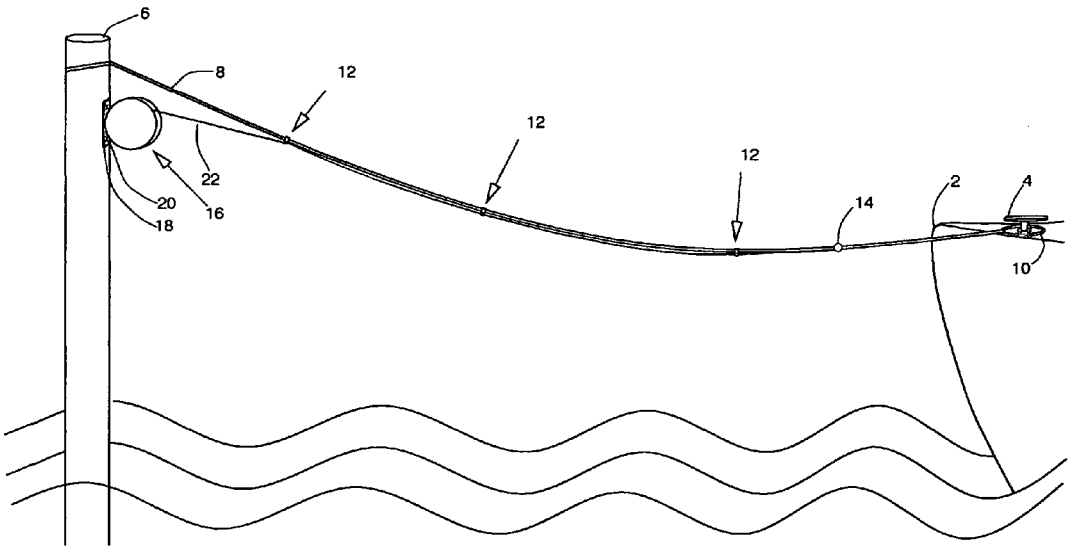
Figure 2:
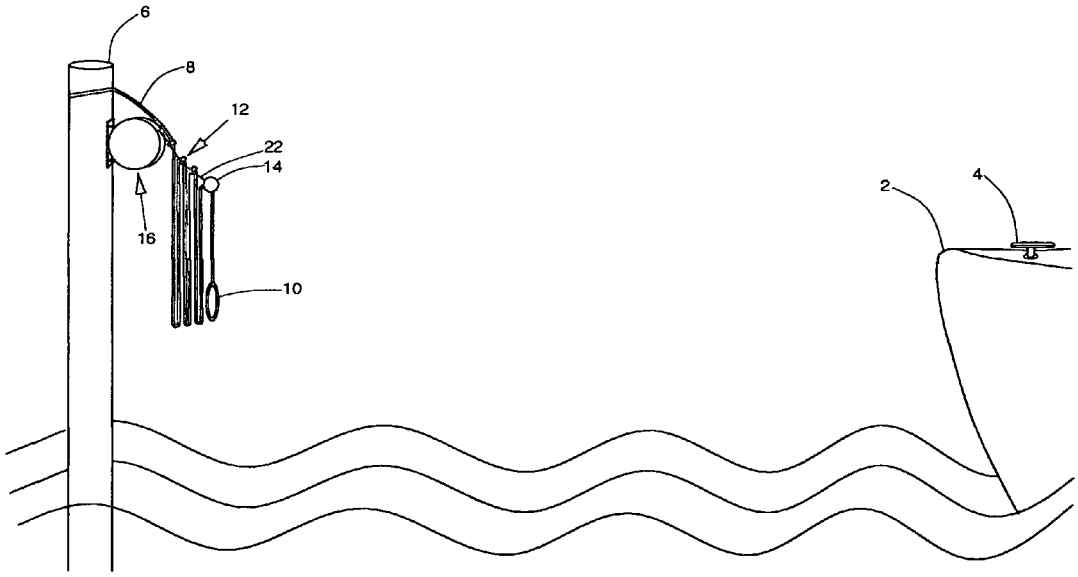

The currently preferred embodiment is illustrated in FIG. 1 in a fully extended configuration in which the vessel is docked, and in FIG. 2 in a fully retracted position in which the vessel is undocked. FIG. 1 shows a vessel 2 in its slip or at dock tied to a piling 6 or other such fixed structure, using one or more docking lines 8. Each docking line is usually though not always terminated in a closed loop 10, which is fastened around a stanchion, cleat, or other fixture 4 on the vessel to dock it—that is to tie it to the fixed structure.

Attached to the piling 6 is an assembly 16 for retracting, storing, and allowing the extension of a retrieving line whose purpose is to reel in the docking line when so desired, and to pay it out again when that is wished. In this embodiment this assembly comprises a spring-operated retraction reel, illustrated in FIG. 4, around which the retraction line is wound by the action of the spring. It is understood that many configurations are possible for such an assembly, and most will function as described herein. One end of the retrieving line 22 is attached to the housing or frame 26 of assembly 16, and the free end passes through opening 28 in its housing and through a channel in each of the attach fitting assemblies 12, which are each fixed to the docking line 8, and terminates and is attached to stopper 14 which is attached to docking line 8 near its loose end. The retraction reel assembly 16 is attached to the piling or fixed structure 6 either through an immobile fastening base 18 or via a hinge 20 to that base, which allows said assembly to pivot around its vertical axis. The hinge could also be made horizontal so as to allow pivoting around the horizontal axis. Either configuration would allow it be moved as far away from the vessel as possible when retraction of the docking line is complete.

The retractor assembly 16 can be similar to clothes-line retractors or dog-leash retractors in common use, many of which are in the public domain. It can use a conventional spring or a constant-tension or negator spring to produce its tension, either being shown as 34, which tension is transferred to the retraction line 22 through reel 32 or other means of holding the traction line under tension, with enough capacity to accommodate the anticipated full length of the docking line. The docking line attach fitting assemblies 12, of which three are illustrated though more or fewer could be used, are each attached to the docking line 8 by any of a number means including threading by yarns, attaching with adhesive compound, attaching with threads, or by compression, which is illustrated. Stopper 14 is a structure or protuberance attached to the docking line, which is made too large to pass through the attach fitting assemblies 12 or shaped appropriately for the same effect. This stopper could be made of metal, plastic, rubber or other soft material to minimize shocks upon sudden stoppage or damaging the vessel or fixed structure.

FIG. 2 illustrates the embodiment in its retracted position, and FIG. 4 is a larger drawing of same. The attach fitting assemblies 12 are adjacent to the retraction reel assembly. The stopper 14 on retraction line 22, which is attached to the docking line 8, has pulled the attach fittings to their position adjacent to the assembly 16. The docking line 8 hangs in half-loops from the attach fittings, the reel assembly, and the stopper, as does the end of line 8 including loop 10 if used. All portions of the docking line are disconnected from the vessel, are proximal to the piling or fixed structure, and hang out of the water.

The retraction reel assembly is illustrated in FIG. 3. It consists of its housing 26 which is attached to a hinge 20 which itself is attached to a mounting plate 18, which can be flat or curved to fit a piling. FIG. 3 also shows the reel assembly mounted to a different mounting plate 19 which is deeper so as to space the embodiment further away from the piling when the embodiment is used with a floating dock, which is not affixed to any supporting piling, the extra spacing being to allow any folds in the retracted docking line 8 that might contact the dock during the highest tides to fall on the dock away from the piling so as not to get caught between dock and piling as the water rises and falls. The housing 26 has an optional sturdy ring 27 attached to it near to the opening 28 through which the retraction line 22 emerges from the housing, which ring is held at an offset position from the housing by struts 29. This ring is too small to pass the attach fittings 12 or the stopper 14. The ring 27 and its supports on a reel assembly may not be necessary if the reel housing is sufficiently sturdy to withstand the forces from the fittings, rings, stopper, and docking line, or it can be so designed to the same end. The retrieving line 22 winds around the internal reel 32, which is free to rotate around a fixed spindle 30, and is connected to the reel at one end and the other end passes through the hole in the housing 28. There is a spring connecting the reel and the fixed spindle, which is wound and unwound by rotation of the reel.

FIG. 5 shows one means of attaching stopper 14 to the docking line 8, in this example via a compression fitting attached to the stopper, and operated by a threaded bolt and nut 36 and 37. FIG. 3 is a larger drawing of the retracted embodiment, illustrating the elements described above. Though it is expected that the attach fittings on docking line 8 will be pulled snug against each other by the stopper under the pull of the retrieving line, some space is shown between them in this figure for clarity of illustration. In addition FIG. 6 shows an alternate docking line ending in which the loop 10 is not at its end by at some distance away, which is also used on some vessels. Indeed in many cases there is no end loop at all, the end of line 8 being wrapped around the vessel cleat 4 for docking.

Figure 7:
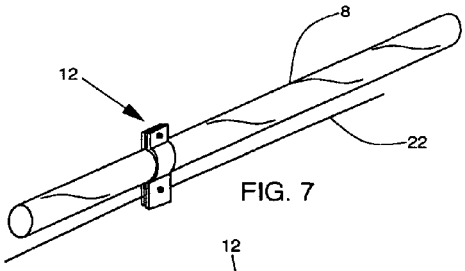
Figure 8A:
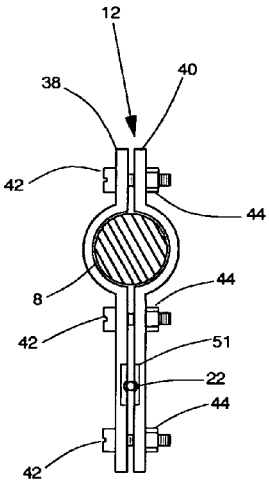
Figure 8B:
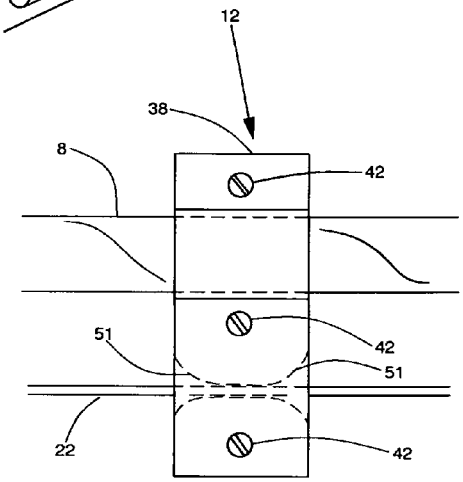
Figure 8C:
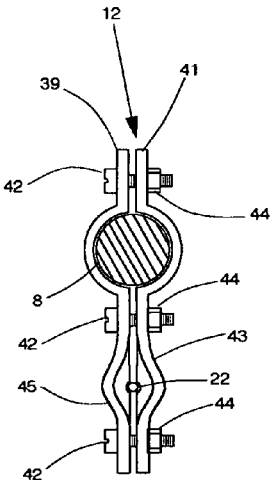
Figure 9A:
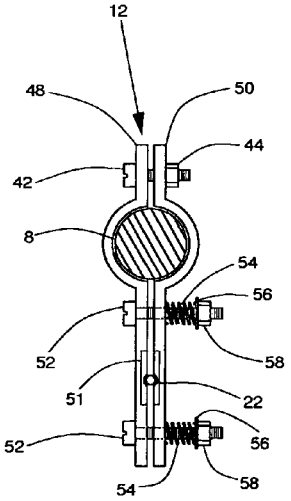
FIGS. 9A-9C are views of two alternate configurations of the attachment fitting of FIG. 7, with friction adjustment means
Figure 9B:
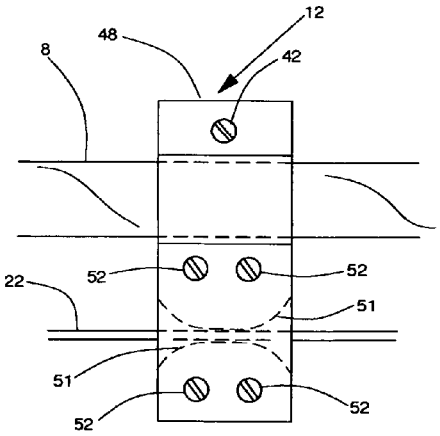
Figure 9C:
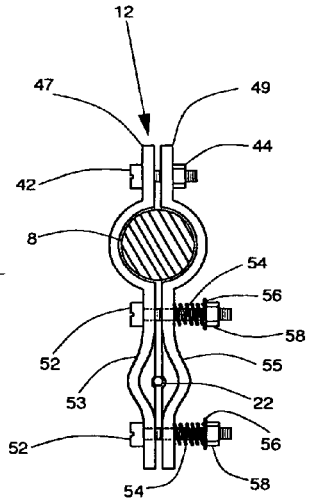

The docking line attach fitting assemblies 12 are detailed in FIGS. 7-9. FIG. 7 shows a fitting 12 attached to docking line 8 and the retrieving line passing through a channel in 12. FIG. 8A shows an end view of the fitting, illustrating a configuration consisting of two identical mirror image parts 38 and 40 which are clamped onto line 8 by bolts 42 and locking nuts 44. The lower part of the fitting halves contains the opening through which the retrieving line 22 passes. FIG. 8B shows a frontal view of the fitting part 38 and bolts 42, and also illustrates the shape of the channel for the retrieving line 22 on its interior surface 51, which is flared in-plane. The frontal view of fitting part 40 is identical to that of 38. FIG. 8C shows an end view of an alternate shape of the end plates of the attach fittings 39 and 41, which have flared channels 43 and 45 out of the plane of the end plates as well as in-plane. FIGS. 9A and 9B show a different design of fitting assemblies 12 which differs from those of FIGS. 8A and 8B in that the two lower bolts 52 and locking nuts 58 are each secured through a spring 54 and retaining washer 56, which allow varying pressure to be exerted by the fitting halves on the retrieving line 22. FIG. 9C shows an alternate view of the end plates of 9A and 9B which have flares 53 and 55 both in plane and out of the plane of the end plates.

Operation of the Preferred Embodiment

The operation of the preferred embodiment will be described for the retraction operation during undocking and then for the extension during docking operation in turn, with reference to FIGS. 1, 2, and 4. The act of undocking the vessel begins by detaching the docking line 8 in FIG. 1 from the vessel, and simply letting it go. This act begins the retracting action, since the tension from the retracting line 22 is no longer offset by the equal and opposite force provided by the vessel when docked. It is anticipated that at least some part of the docking line, with the retrieval line attached, will probably fall into the water. The retrieving line tension provided by reel assembly 16 begins to pull the retrieving line toward and into the retraction assembly, and since the retrieving line is attached to the docking line at stopper 14 near its end it will also thereby begin pulling on the docking line. As this operation continues and the retraction line continuously wraps around the retraction assembly reel 26 driven by spring 34 there will continue to be tension on the retraction line, and since the retraction reel assembly is attached to the piling or fixed object the retraction line 22 will continue to be pulled toward the retraction reel assembly 16.

The unavoidable existence of drag on the docking line due to the water, as well as on the attach fitting assemblies 12 and stopper 14, as the docking line begins to move through the water will generate increased tension forces directed against the direction of motion, and away from the reel assembly. While the water will also cause some drag forces on the retrieving line, since the retrieving line is very much thinner than the docking line those forces will be much smaller. The net result will be that a drag-induced tensioning force will operate on the docking line in a direction away from the fixed structure, and will increase the total tension in retrieving line 22. This drag force will help the retrieval line to slide through the channels in the attach fitting assemblies 12 attached to the docking line, since the retrieval line 22 has a force toward the retraction reel assembly while the docking line and its attached fitting assemblies experience a force away from the reel assembly due to water drag. This differential drag therefore will cause the retraction line to slide through the attach fittings and pull on the stopper 14, which will cause the docking line 8 to move toward the reel assembly.

This process will continue until the first attach fitting hits the retraction reel assembly at ring 27 and stops there. The docking line will begin to sag under the pull of gravity while the retraction line continues to pull on the remaining portions of the docking line by continued pull on the stopper 14. Since the retraction line is prevented from significantly sagging due to its tension, the remainder on the docking line will continue to be pulled toward the retraction assembly, aided by the drag of the water upon the docking line, until the next attach fitting contacts the first fitting and both are stopped at the retraction reel assembly. The process will continue until all attach fittings are pulled into contact at the retraction reel ring 27, or the reel assembly housing if the ring is not used, and the docking line stopper 14 is flush with the attach fittings. Alternately the water drag may be such that some or all of the attach fitting assemblies 12 will come together in the water, and if so then all would be pulled against the retraction reel assembly nearly at the same time. Whichever process occurs the net result is the same, which is that all the attach fitting assemblies with the docking line attached are pulled out of the water by the retraction line and stored near or at the reel assembly. Clearly the action of the spring 34 on the retraction reel 32 and thus on the retraction line 22 must be strong enough that it can lift the entire weight of the docking line and all attach fittings and stopper clear of the water, even if wet.

The net result of the action of the retrieving line tension and the collapsing of the distance between the attach fittings as well as to the reel assembly is that a number of half-loops of docking line will hang from the attach fittings 12, as well as the portion of the docking line beyond the stopper, including loop 10 if such is used, and all portions will hang out of the water. This is the condition of the fully retracted position of the device, illustrated in FIGS. 2 and 3. The spacing between the attach fittings on the docking line is preferably chosen so that the bottoms of the hanging loops of docking line as well as the end loop will be above the highest expected water level. The number of attach fittings is preferably chosen to accommodate the length of docking line that is desired, which in turn depends on many factors including the wind, waves, separation desired between vessel and dock, available bumpers or fenders, and other factors. Both the number and spacing of attach fittings may be set based on other criteria as well. The spring tension of the retraction assembly would be preferably chosen so as to be great enough to reliably retract the docking line to its fully stored position while the line and all attachments were wet and while in the process dragging the docking line and all its attachments through the water, yet not so strong as to make the extension of the docking line so high as to require excessive manual force when docking. This retrieving line tension must also be chosen taking into account the change in such tension between fully retracted and fully extended retrieving line condition, if a negator spring or other tension-leveling spring or device is not used.

The immersion of the docking line and retrieval line during retraction will be very temporary, as it is expected that the lines will be fully retrieved in a matter of seconds. Nonetheless the lines and fittings will probably get wet, and the water on the retrieving line will wet the interior of the retraction reel assembly. Such short term wetting is not harmful, as all such lines are designed for frequent immersion and are subject to rain as well. Importantly however, the embodiment rapidly lifts the docking line out of the water and keeps them there preventing long term immersion, which is the condition to be avoided in order to prevent deterioration of the lines, accumulation of growth of marine organisms, and presenting a hazard to an approaching or departing vessel. Additionally the retraction reel assembly must be so designed with provision for drainage and proper choice of materials that frequent or long term wetting will not disrupt its operation or cause rapid deterioration.

While it is anticipated that the drag on the docking line as it is pulled by the retrieving line will be sufficient to hold back the docking line so that the retrieving line slides through the attach fittings and draws the docking line in with all fittings coming to rest together at the retraction reel, that drag may not be sufficient for a full, orderly, and reliable retrieval. That could occur, for example, if the docking line forms a bend or kink while in the water. Should that turn out to be the case, an increase in the friction between the attach fittings and the retrieval line may be necessary to ensure that the attach fittings and stopper all proceed toward the retraction reel assembly in an orderly way and all the way. To this end the attach fitting assemblies 12 have a provision for adjusting their friction on the retracting line, which is illustrated in FIGS. 9A, 9B, and 9C, in which the friction is adjustable by tightening the locking nuts 58 on bolts 52. This allows not only for increasing or decreasing the friction on the retrieval line but for the setting of the level of friction to be different for each of the attach fittings.

This may be important because in practice it would be advantageous to adjust the friction to be lowest on the attach fitting closest to the retrieval reel and greatest on that furthest toward the end of the docking line, with in-between fittings having in-between levels of friction. This differential friction will generate differential tensioning forces, the least near the end of the docking line that is attached to piling 6, and will ensure that he closest attach fitting, with its portion of the docking line attached, is pulled into contact with the retraction reel first, with the other attach fittings and their attached portions of docking line following in order, with the furthest ones being last. Alternatively the attach fittings, with the docking line attached, could come together while still in the water, and then be pulled toward the retraction reel at the same time. The level of friction for each attach fitting could be preset at the time of manufacture for different expected conditions, or at the time of installation, followed by adjustments based on experience or by trial and error.

Another feature of the attach fittings is that the design of the opening or channel through which the retraction line 22 passes through each fitting assembly when they are attached to the docking line has its surface smoothly expanded into a greater size toward both sides of the fittings. This is shown as 51 in FIGS. 8A-8B and 9A-9B. These wider openings define a smooth and gradually narrowing channel to prevent the retrieval line from binding against the fitting plates 38, 40, 48, or 50 should the geometry of the docking line and attached fittings during retrieval be temporarily such that the retrieval line enters or exits a fitting at an angle other than about 90 degrees. This situation could readily arise if the friction adjustments on the attach fittings are improperly set, or have changed with time or for other reasons, and the retrieval process results in such angles. Furthermore during the docking maneuver and extension of the docking line these angles could also vary considerably from being right angles, and the gradual expansion of the opening 51 in the attach fittings will ensure that binding or damage to the retrieval line does not occur during either undocking or docking maneuvers. While an improvement, the attach fittings have a further alternate configuration to address potential binding that could occur if the pull on the retrieving line 22 is substantially out of the plane of the end plates of the attach fittings 12. These alternate configurations of the end plates, 39 and 41 in FIGS. 8C and 47 and 49 in FIG. 9C have, in addition to the in-plane smooth flare an additional out of plane smooth flare on both sides of both end plates, shown as 43 and 45, and 53 and 55 for the attach fittings without and with the friction adjustment means respectively.

The undocking operation of this embodiment is simplicity itself. On leaving the dock or slip the vessel operator simply lifts the end loop or unwraps the line end of each docking line from its cleat or other fastener on the boat, and lets it go. The operator does not have to tie the docking lines to a dock cleat or place them out of the way of other operators or people on the dock, nor attempt to throw the docking line onto a dock so that it stays out of the water. The operator does not have to give any thought whatsoever to the docking line once he has let it go, and can instead concentrate on maneuvering the vessel out or away from the slip or dock without giving a single thought to safe storage of the docking lines, or worry lest they fall in the water and stay there, and thus get covered with marine organisms and create a navigation hazard. The operation of pulling the docking line out of the water and holding it thus and near to the piling or fixed structure is solely due to the functioning of the embodiment as discussed above, and is not dependent on any rotation of the retraction reel assembly about its vertical or horizontal axis which rotation, if used, simply ensures that the entire embodiment lies as far away from the vessel as possible. The retraction reel assembly could also be fitted with a spring or weight to rotate it out of the way once the docking line were retracted if the rotation axis was vertical, while gravity would ensure such rotation if the axis were horizontal.

The extension process for docking the vessel is the reverse of the above. The end of the docking line which hangs from the retraction reel assembly is grasped by hand or with a boathook or the like and pulled toward the vessel. That action causes the docking line to extend to its full or required length, since the two are attached to each other, pulling the tensioned retraction line with it automatically such that all elements end up in place as shown in the same configuration as in FIG. 1 again. To that goal the end of the docking line could beneficially have in it a loop like 10 for easy grasping by hand or a boat hook, though if a loop is not used, as is common in a fraction of normal docking line uses, the operator could as easily grasp one of the hanging half-loops of docking line by hand or with a boat hook. As the docking line is pulled toward the vessel by the operator the line will pull first on the stopper and then on the attach fittings in turn. The greater friction forces on the outward attach fittings and lower drag forces on the innermost fittings will ensure that they are all deployed in the reverse order to that when being retracted, and all will smoothly extend as the docking line extends. When the docking line has reached sufficient extension the operator can easily place the loop on the docking line directly over a cleat on the vessel and then let go, thus accomplishing docking with only one manual operation. Once the docking line is attached to the vessel via the end loop 10 or tied to the cleat the vessel is secured with no additional steps required.

The operation of the retraction reel in docking and extension of the docking line is automatic, powered by the spring-actuated reel in the retraction assembly. The pull exerted by the operator need only exceed the tension provided by the tensioning mechanism, which is envisioned to be small, especially if the retrieving assembly spring is of the constant-force or negator type, in order to retrieve the docking line and dock the vessel. Thus the operation of this embodiment of the docking line management system changes both the docking and undocking maneuvers from what are now complex, time consuming, difficult, and tension filled operations into a hassle-free and easy 1-step docking and 1-step undocking operations, each of which requires only one manual operation, and a complete docking and undocking sequence only requires a total of two manual operations regardless of the order in which performed.

Description of the First Alternate Embodiment

FIGS. 10 through 18C apply to the first alternate embodiment.

Figure 10:
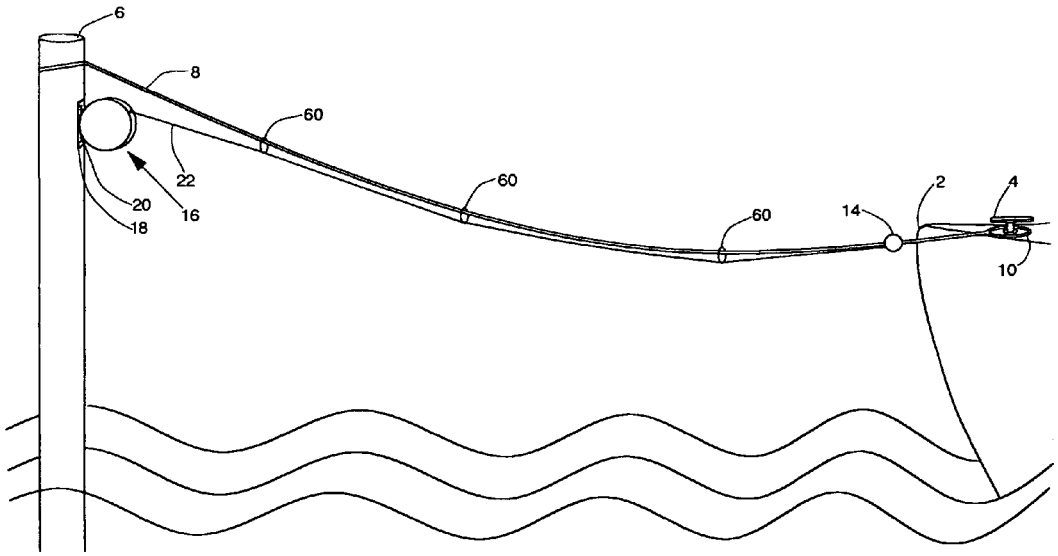
FIG. 10 illustrates the extended, or docked configuration of the first alternate embodiment
Figure 11:
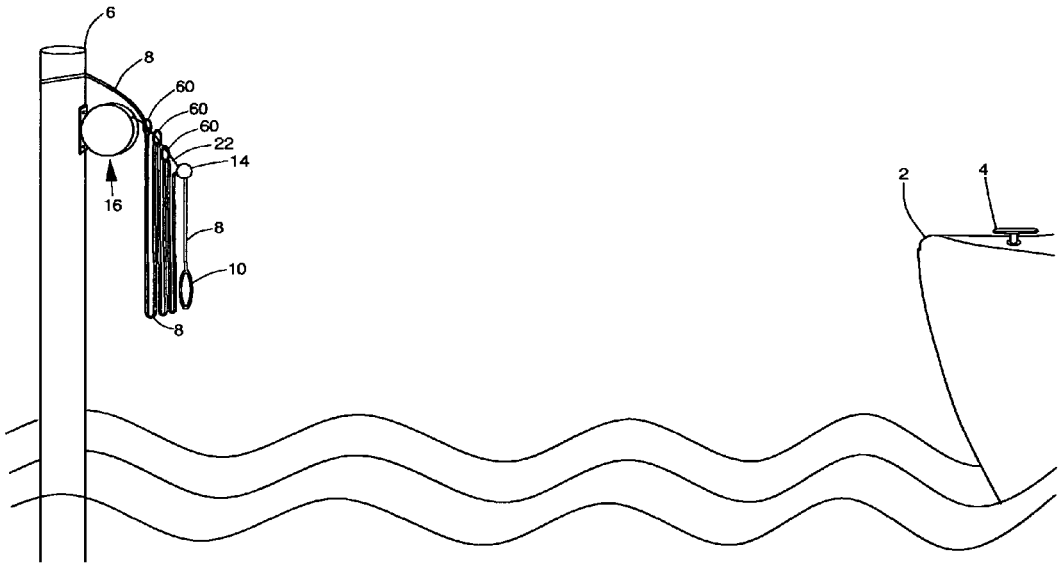
FIG. 11 illustrates the retracted, or undocked configuration of the first alternate embodiment
Figure 12:
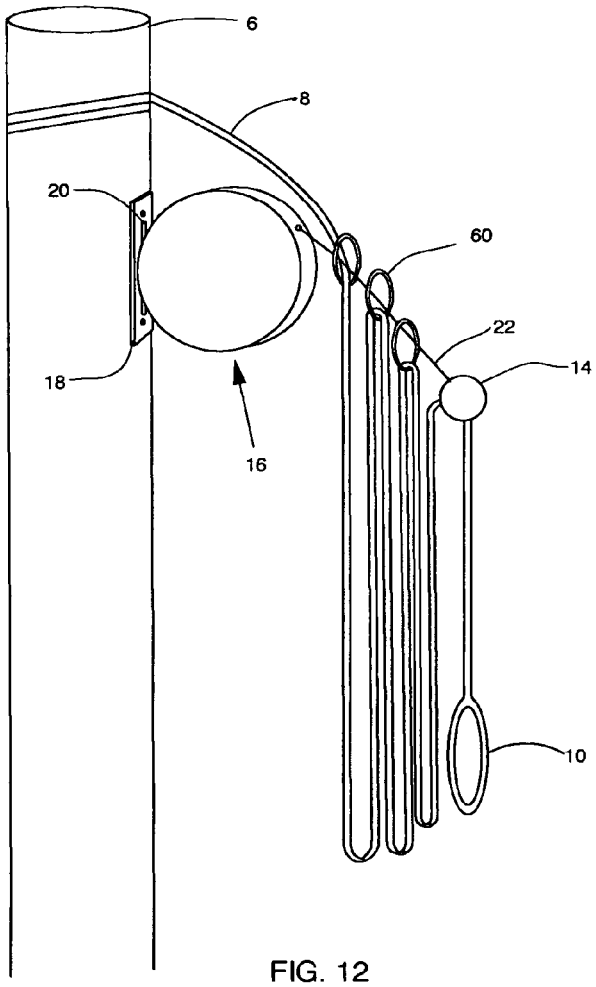
FIG. 12 is a larger drawing otherwise the same as FIG. 11
Figure 14:
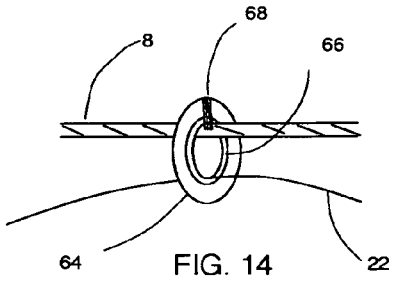
FIG. 14 illustrates a ring as in FIG. 13 but including a friction-increasing material layer
Figure 13:
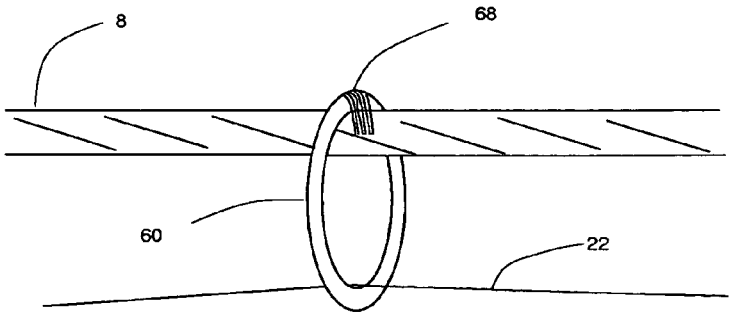
FIG. 13 illustrates a ring attached to the docking line with threads, and holding the retrieving line
Figure 15:
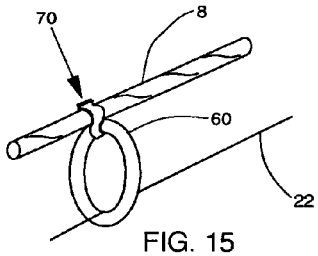
FIG. 15 shows a ring attached to the docking line with a clamp fitting
Figure 16A:
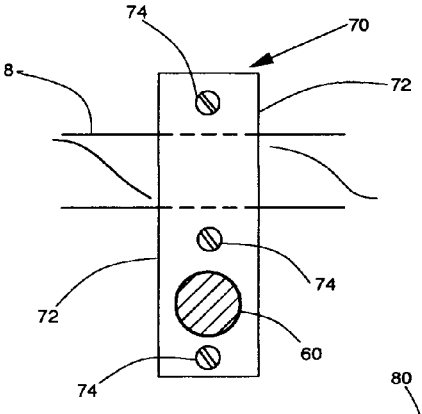
FIG. 16A-16B show two views of the attach fitting of FIG. 15
Figure 16B:
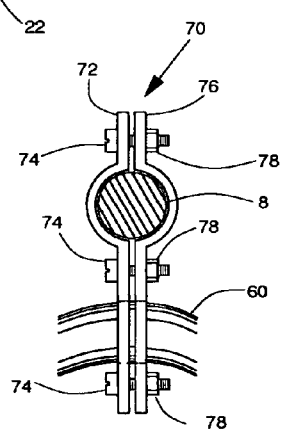
Figure 17A:
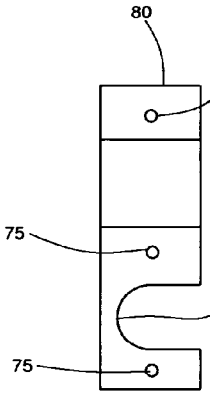
FIGS. 17A-17B show two alternate plates comprising the fitting of FIG. 15
Figure 17B:
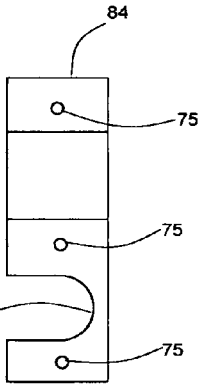

The first alternate embodiment is shown in FIG. 10 in the fully extended or docked position and in FIG. 11 in the fully retracted or undocked position, and in a larger drawing in FIG. 12. This embodiment differs from the that of the currently preferred embodiment in part in that the retrieving line 22 passes through rings 60 attached to the docking line 8, rather than through attach fittings. While seemingly superficial this has fundamental ramification differences in the retrieving operation. The stopper 14 is made large enough to not pass through rings 60. The rings 60 are attached to docking line 8 though any number of means, the ones illustrated in FIGS. 13 and 14 being threads or stitches 68. The rings can also be made with an increased friction layer 66 on the inside surface. The rings can alternately be attached to the docking line with attach fitting assemblies 70, as shown in FIG. 15, and which are detailed in FIGS. 16A-17B, which are not the same as attach fittings 60. Frontal and side views of the attach fittings are shown on FIGS. 16A and 16B respectively. The fittings consist of end plates 72 and 76, which are held together by bolts 74 and locking nuts 78. The end pieces 72 and 76 have a circular hole each through which a ring 60 can be attached, assuming that the rings are so designed as to allow their insertion into a closed circular opening, as well as holes 75 for the attach bolts. Alternately end pieces 80 and 84 can be used, shown in FIGS. 17A and 17B, each of which has an opening 82 and 86 respectively, which allow the rings to be inserted and retained and then the end pieces to be securely bolted through holes 75. Either of the configurations of FIGS. 16A and 16B, and those of FIGS. 17A and 17B would have the holes for accommodating the rings larger that the cross-sectional diameter of the rings themselves, which would allow the rings to rotate freely after the end pieces are joined.

An optional water drag disc 86 is shown in FIGS. 18 A-C, with an attached compression fitting designed to clamp the disc to the docking line via a bolt and locking nut, whose purpose would be to hold back the end of said line due to increased water drag on said disc as the line is reeled toward the retrieval assembly. Such a disc could be of any size and appropriate thickness and material, and could be flat or could be conical, depending on the degree of drag creation desired. This disc could be attached to the docking line using adhesive, thread, or be simply held in place by knots or loops of the docking line itself if desired, to the same effect of holding it in place. One disc could be attached near the vessel end of the docking line, or several along its length as desired.

Operation of the First Alternate Embodiment

The operation of this embodiment is very similar to that of the currently preferred embodiment, with the principal differences being in the use of rings rather than attach fittings to hold the retrieving line 22, and in tension control means. In retraction the retrieving line 22 pulls on stopper 14 which engages the rings 60, one at a time, and pulls them into contact with the retraction reel assembly, whose design can be similar to that of the currently preferred embodiment except for the design and size of the stopper ring 27 and its supports 29, if used, which has to accommodate the larger diameter rings. The advantage of using rings rather than attach fittings 12 of the currently preferred embodiment is that the retrieving line 22 slides more freely through them and will not have a tendency to jam due to binding from line 22 not going through the attach fitting exactly in line with a hole through the fitting. The disadvantage is that the lack of friction between the rings and retrieving line may result in uneven retraction and subsequent jams in the retrieval process as the docking line is in the water.

To combat this potential problem the inside of the rings can be made with a friction increasing material such as rubber, which would help in increasing the tension force which helps to keep the docking line from kinking. This material is illustrated in FIG. 14 as 66, and could be deposited on the sides as well as on the inside of the rings. While the material would not increase the friction significantly were there no kinking, that is if the docking line stayed substantially straight during retrieval, if the docking line backed on itself or formed kinks the pull on the retrieval line would create substantially more resistance due to the increased friction from 66, which would automatically create forces tending to straighten out the docking line during retrieval. These forces would be minimized during docking since the retrieval line 22, as shown in FIGS. 10-12, generally passes straight though the rings generating little friction. An alternative would be to avoid depositing the friction-increasing material 66 on the inside the rings opposite to where they attach to the docking line so that the retrieving line slides easily through the rings during deployment from the undocked or retracted position.

Figure 18A:
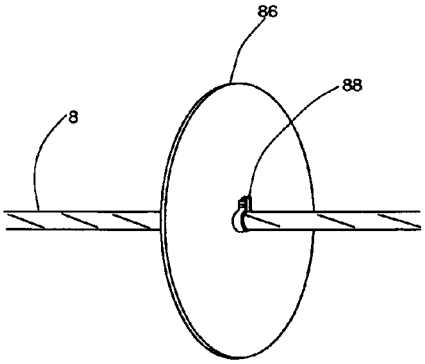
FIGS. 18A-18C are three views of a water drag disc attached to the docking line
Figure 18B:
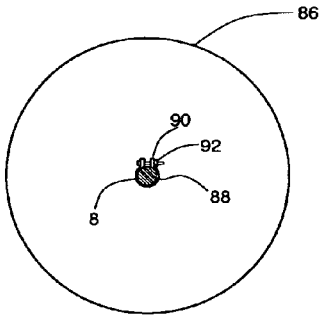
Figure 18C:
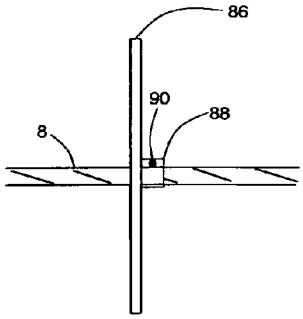

Another alternative for increasing the frictional forces when undocking is to attach a water drag disc 86, shown in FIGS. 18A-18C, which is fastened to the docking line 8, preferably at some point between the stopper 14 and the first ring nearest to it. In fact, if such a disc is used the stopper does not require to be of large diameter, if it needs to exist at all, as the disc will pull the rings, with the docking line attached, toward the retraction reel and the retracted position since the retrieving line attaches to the docking line near or at the location of the drag disc should one be used. The disc can be attached to the docking line with any numbed of means, the using of a clamp 88 operated by a bolt 90 and locking nut 92 being shown, in which the clamp is attached to the disc on a portion of its surface.

The operation and advantages of this first alternate embodiment are otherwise similar to that of the currently preferred embodiment, attaining the same end objectives, and will not be repeated here.

Description of the Second Alternate Embodiment

FIGS. 19 through 23 apply to the second alternate embodiment.

Figure 19:
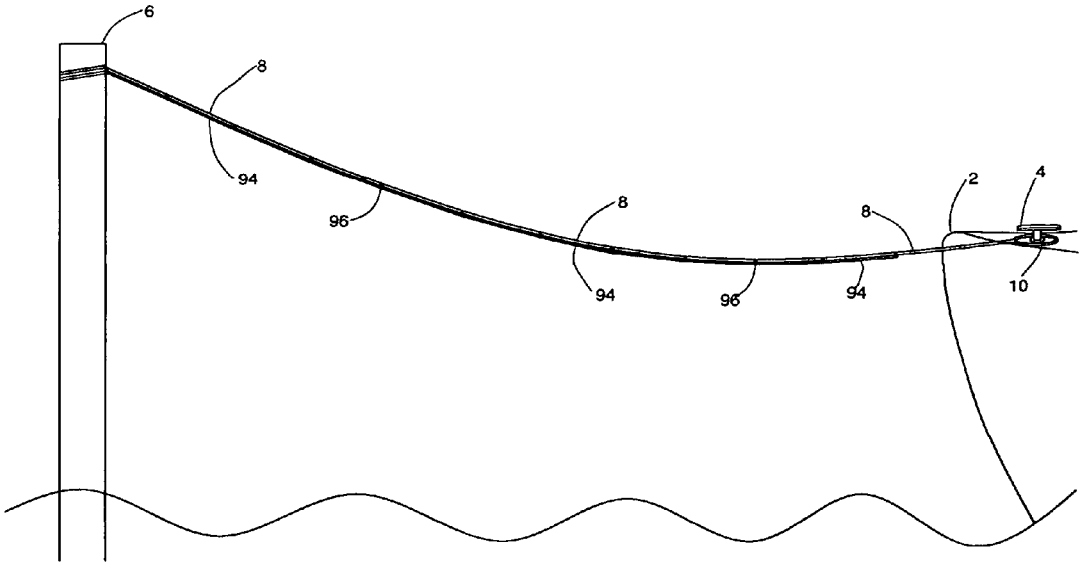
FIG. 19 illustrates the extended, or docked configuration of the second alternate embodiment
Figure 20:
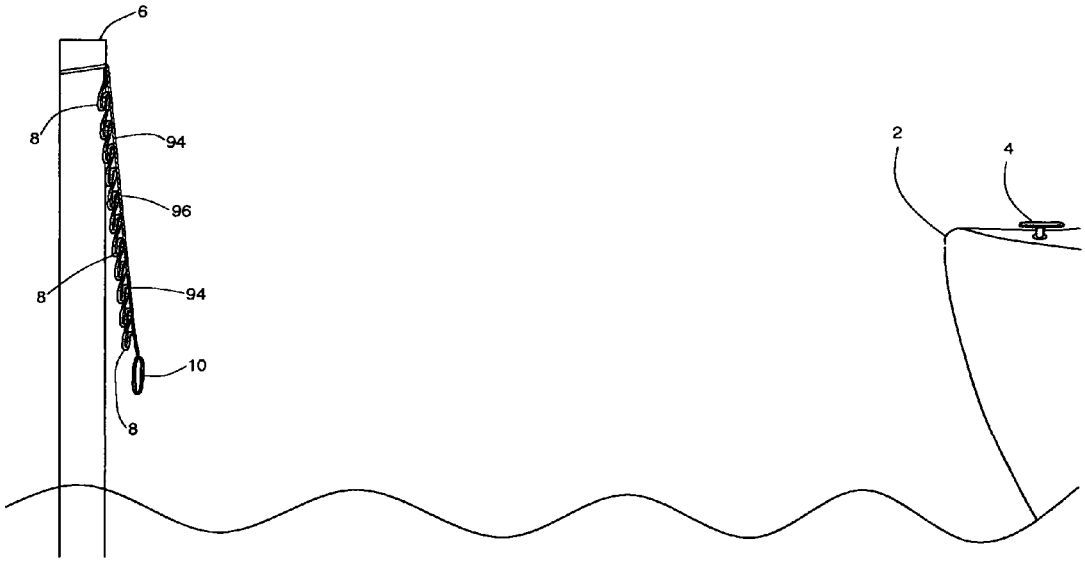
FIG. 20 illustrates the retracted, or undocked configuration of the second alternate embodiment
Figure 21:
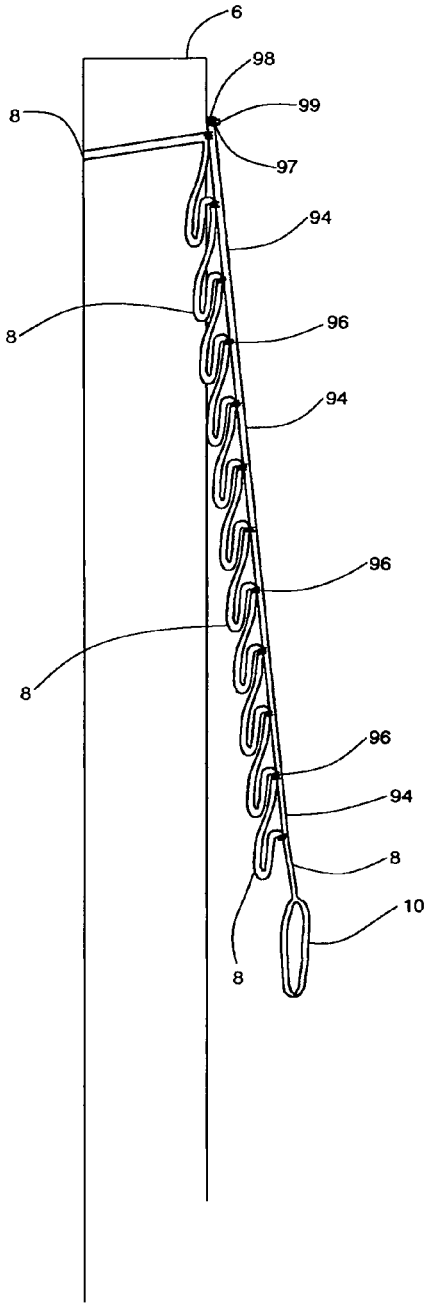
FIG. 21 is a larger drawing otherwise the same as FIG. 20

This embodiment attains the required retraction force not by the use of a spring-actuated reel as do the currently preferred embodiment but by the use of bungee cords. It is illustrated in FIG. 19 in the fully extended or deployed state and in FIG. 20 in the fully retracted, or undeployed state. The retracted state is further illustrated in the larger drawing of FIG. 21, and in FIG. 22 showing attach means. The docking line 8 has attached to it at intervals along its length elastic cords known as bungee cords, usually made of some rubber-like material. These cords span most of the length of the docking line and could consist of a single long bungee cord fastened at multiple locations, or separate bungee cords fastened at their ends, with the ends preferably touching but could be attached with gaps in between cords. The bungee cords are identified as 94, and shown attached by means 96 at their ends, or if one long line then at several locations. The retracted or undocked configuration is shown in FIGS. 20 and 21, in more detail, illustrating the sagging of the docking line between the points of attachment of the bungee cords 94 in the retracted configuration. The bungee cord closest to the piling 6 can be attached to the docking line by a number of techniques including threads, compression fittings, or bands including hook-and-loop fasteners, or fastened directly into the piling, the one illustrated in FIGS. 21 and 23 being a screw 99 with large head and washer 97 driven though the bungee cord and its end compression fitting 98 into piling 6, though fastening to the docking line is simple and effective and has the additional benefit that the entire embodiment can be easily transferred to a different location. The means of attaching the bungee cords to the docking line could be many including compression fittings, and hook-and-loop bands, or stitching, but the thread stitching (ligature) options 96 are shown in FIG. 22 in which the stitching goes through both the docking line and the bungee cords, and in FIG. 23 where the stitching encompasses both the docking line and the bungee cord and is pulled tight.

Operation of the Second Alternate Embodiment

This embodiment operates in a very similar way to that of the currently preferred embodiment in its overall functions, but very differently its implementation. When, during undocking, the docking line is let go the line probably also falls into the water, and the as the bungee cords assume their shorter rest length between the fastenings 96 they will pull the various segments of the docking line together causing those sections to go limp. This process occurs in all the segments essentially simultaneously so that the length of the bungee line, with untensioned sections of docking line attached, moves toward the portion of the docking line which is attached to the piling 6. This process will pull all the segments of the bungee cord and attached docking line out of the water until the nearly relaxed bungee cord hangs from the piling 6, with the half-loops of docking line between the attach points sagging in between. This position is illustrated in FIGS. 20 and 21.

The bungee cords and their attachments should be designed so that the retracted position of the cord is such that the entire length hangs out of the water and against the piling 6. If used on a floating dock a spacer, not shown, can be used for mounting on the piling just under the attach point of the docking line and bungee cords so as to move the hanging bungee cord and docking line assembly away from the piling to avoid getting pinched as the dock floats up and down on the piling, similarly as was described in the currently preferred embodiment and first alternate embodiment. Commercially available bungee cords generally have a limit for how much they can safely stretch, which is larger the greater their cost. Even so, the generally accepted limit is a safe stretch of length between a factor of 2 and a factor of 4. The design of the system must therefore employ a sufficient number of segments of bungee cords, each fastened to the docking line at its ends, whether all of a given length or uneven lengths, so that the fully retracted length of the bungee cords equals that needed to keep the retracted assembly out of the water for a given desired length of fully extended docking line.

Take as an example a fully extended docking line length of 3 meters and maximum allowable hanging length when fully retracted of 1 meter. Regardless of the number of bungee cords used they must each be able to stretch a factor of three, which is given by the desired ratio of extended to collapsed length of the docking line. If for example 5 lengths of bungee cord are desired to be used then each must be 0.6 m long when stretched and 0.2 m long when relaxed. If 2 lengths are desired then each must be 1.5 m long when stretched and 0.5 m long when relaxed. If one cord is desired then it must be 3 m long when stretched and 1 m long when relaxed. In all of these examples the bungee cords have to be attached to the docking line at a number of points in order to keep the sagging half loops near the end of the docking line from significantly increasing the hanging retracted length. The choice would be made on the costs of attachment versus the costs of the bungee cords themselves. In addition the tension force generated by the bungee cords must be sufficient to lift the docking line completely out of the water when wet, which would be satisfied by proper choice of the bungee cord characteristics.

This embodiment has a very attractive simplicity, with a minimum of parts that could bind or fail, yet meets all the same objectives of the currently preferred embodiment. It principal disadvantage is that in order to implement a long docking line yet maintain a short hanging length when retracted, the ratio of these lengths may result in requirements for bungee cords with a large ratio of stretched to relaxed length and thus possibly shorter service life. In addition the outside cover or surface material of the bungee cords must be substantially resistant to deterioration by sunlight, which otherwise could shorten their service life. The operation and advantages of this alternate embodiment are otherwise similar to that of the currently preferred embodiment, attaining the same end objectives, and will not be repeated here.

Description of the Third Alternate Embodiment

FIGS. 24 through 27 apply to the third alternate embodiment.

This embodiment is similar to the currently preferred embodiment except in the source of the tensioning forces, which in this embodiment is provided not by a spring actuated retraction reel acting on line 22 but rather by a set of weighted pulleys acting on a retraction line 104. This embodiment is shown in the docked or extended mode in FIG. 24 and in the undocked or retracted mode in FIG. 25, and in a larger view in FIG. 26. The retracting line passes through attach fitting assemblies 12 attached to the docking line 8, as in the currently preferred embodiment. Alternately the rings, line stopper, and drag disk of the first alternate embodiment could be used as well, though this description will use the attach fittings of the currently preferred embodiment without prejudice. A supporting structure 100 which is attached to the piling 6 holds a number of blocks 106, each with one pulley, suspended from 100 by a strap or other structure 110. This structure has on it one or more rings or U-shaped fasteners 102 attached for supporting docking line 8 on its way from the piling to the vessel, and to keep it from sagging onto the blocks. The blocks are connected to a lower set of blocks 108 by the retrieving line 104. Each block 108 is connected to a weight 120 by a strap or other structure 116. The upper blocks are each suspended by a structure with an attaching bolt or similar fastener 112 to structure 100 which allows rotation about a horizontal axis. The weights are suspended from the lower blocks, each with one pulley, by structures 116, attached to the blocks by fasteners 118 that support the weight yet allow rotation about a horizontal axis. The block attachment structures may not need to be able to rotate on their own since the pulleys do rotate, satisfying the same need for self-alignment and possibly eliminating the need for rotatable fasteners.

The entire mechanism could be mounted not directly to the piling 6 but through a vertical hinge 103 in FIG. 27, mounted to a mounting plate 105 which is attached to the piling through screws 107. The retracting line 104 is led alternating from upper to lower blocks and then fastened to the piling or to the support structure 100 at the end. The components 100, 103, 104, 105, 106, 107, 108, 110, 112, 116,118, and 120 can be enclosed in a cover to keep out the elements if wished. This enclosure, not shown, could be similar to a shaped umbrella or box with open bottom to allow the weighted sheaves to descend as the docking line is retracted. The enclosure could also have openings for the docking line and retracting line to pass through them. The docking line with attach fittings and retracting line would hang outside this enclosure when retracted.

Operation of the Third Alternate Embodiment

The operation of this embodiment is similar to that of the currently preferred embodiment except that the tensioning forces are generated by the weighted pulleys. It is a simple arrangement and inherently has the desirable characteristics that the tensioning force provided is constant as the docking line is extended or retracted. The means of tension and friction control would be the same as those for the currently preferred embodiment, but could just as well be those of the first alternate embodiment. In addition, in this embodiment the tensioning force can be changed by changing the weights 120 to accommodate a heavier docking line or to change the tension when fully extended so as to better control the vessel's positioning in the presence of tides or winds; or alternately to reduce the tension force that the operator must overcome when extending the docking line during docking. The disadvantage of this embodiment is the complexity and number of moving parts, which could result in shorter life unless shielded from the elements. The operation and advantages of this alternate embodiment are otherwise similar to that of the currently preferred embodiment, attaining the same end objectives, and will not be repeated here.

Description of the Fourth Alternate Embodiment

FIGS. 28 through 31 apply to the fourth alternate embodiment.

The fourth alternate embodiment is identical to that of the third alternate embodiment except for the replacement of the several separate blocks and weights with a single set of two blocks, each containing a number of independent pulleys, and the replacement of the several weights with a single larger weight. It is shown in FIG. 28 in the fully extended, docked configuration and in FIG. 29 in the fully retracted or undocked configuration, which is also shown in the larger drawing of FIG. 30, and illustrates it use with the ring of the first alternate embodiment though it could as easily be used with the attach fittings of the currently preferred embodiment. The multiple pulley blocks are supported from a structure 126, from which hangs the upper block 136 suspended by structure 134, which is attached to the support 126 by a fastener that allows rotation about a horizontal axis or through penetration of a hole in 126. The lower block 138 has a structure that supports the weight 142, which structure is free to rotate about a horizontal axis. The system may function well without the suspension structures being able to rotate at all as the rotating pulleys provide a degree of self-alignment inherently. The retracting line 124 winds through all of the pulleys, alternating upper and lower, and is then attached to the upper structure 126 or to the piling 6. The docking line 8 could pass through one or more rings such as 102 in FIG. 26 if desired, though not shown in FIGS. 28-30. The structure 126 could be mounted directly to the piling or instead through a pivot or hinge on the vertical axis, either to a mounting block if on a floating dock, or directly to the piling. One such means of attachment is shown in FIG. 31, with the structure 126 mounted to a vertical hinge 146 which in turn is mounted to a mounting plate 144 which is attached to the piling by screws 148.

Operation of the Fourth Alternate Embodiment

The function and operation of this embodiment is the same as that of the third alternate embodiment, with the difference that the two multi-pulley blocks replace the multiple separate blocks. In action, then, the single lower multi-pulley block will also move up and down in the extension and retraction operations respectively under the effect of the single weight. This embodiment has the advantages that it is even simpler than the third alternate embodiment and contains fewer parts leading to possibly greater reliability, and does not extend as far away from the piling and toward the vessel, lessening any hazard. It also maintains the same constant retrieving line tension as does the third alternate embodiment. The two multi-pulley blocks may cost more or less than the plurality of single-pulley blocks of the third alternate embodiment. It also could have shorter life unless shielded from the elements. The operation and advantages of this alternate embodiment are otherwise similar to that of the currently preferred embodiment, attaining the same end objectives, and will not be repeated here.

CONCLUSIONS, RAMIFICATIONS, AND SCOPE

These embodiments, in contrast to current and previous art, will make the handling and storage of docking lines for boats and other aquatic vessels easy, safe, and quick, both when leaving a dock or slip and when returning to it. In particular they will allow the operator when undocking his vessel to detach the docking line from the vessel and simply to let it go, the device proceeding to retrieve the docking line, store it neatly in such manner that all the docking line lies clear of the water and close to a piling or other fixed structure and away from the vessel, and presenting the docking line neatly ready for the next docking opportunity, all in one easy manual operation. It will also enable an operator when docking the vessel to grasp the end of the docking line which will be available, presented, and ready for use as stored, pull it onto the vessel and attach it there, likewise all in one easy manual operation, which will automatically cause the embodiments to be in the identical configuration as they were at the beginning of the undocking operation. Thus docking and undocking requires only one manual operation each, and a complete docking and undocking sequence only requires a total of two manual operations regardless of the order in which performed. When used in several directions from several pilings or docks to the vessel the constant tension from the docking lines will also maintain the vessel substantially centered in the slip in the presence of variable winds and tides. This simplicity, safety, and convenience of operation are not anticipated in prior art found, nor are they available in any product on the market.

The retraction lines used can be thinner and much weaker than the docking lines they will retract as they never carry either static or dynamic vessel docking loads or stresses, those being solely carried by the stronger and heavier docking lines and transferred directly to the piling or dock. This fact also allows the retraction reel or weighted blocks or bungee cords of the different embodiments to be much lighter, weaker, and smaller than they would have to be if they had to handle the full tension loads or stresses generated by the vessel. All the embodiments accomplish the desired functions without exerting forces on the retrieving lines greater than those necessary for overcoming the weight of the docking line and the fittings and other attachments mounted on it, and such forces can be readily generated by practical spring reels, weighted blocks, or bungee cords. Therefore it is expected that the force that an operator would have to use to extend the docking line from its stored position will be low, and not a burden to any operator regardless of his or her physical strength.

An added benefit of the embodiments is that when a docking line fashioned according these embodiments is attached to the vessel, the tension from the spring actuated reel, weighted pulleys, or bungee cords will act continuously on that line and pull on the vessel. Similar pull will also be experienced from all the other such docking lines used to attach to the vessel. Since these docking lines are usually attached to the vessel from several directions such as forward left and right sides and rear left and right sides, the constant tension in the embodiments' docking lines will tend to keep the vessel centered in its slip at all times. This is an advantage over using the usual non-tensioned docking lines in that the vessel is substantially kept away from the sides of its slip, thus avoiding damage due to scraping against the dock or slip due to wind, waves, changing water level, or other causes.

This docking line handling system can be used alone, or in conjunction with any number of boat-hook devices intended to enable easier reaching or grasping a remote loop or piling from the vessel. The retrieval loop at or near the end of the docking line can be a part of the docking line, or be made of plastic, metal, or other materials and attached to it. It could also could be constructed having two orthogonal planes of material, or in any other shape if it would be better for it not to lie flat when in the retracted position to make for easier grasping for retrieval. In practice, most docking lines that are pre-fabricated contain such a loop on one end, and that end is used in attaching the docking line to the fixed dock or piling then the free end will have no loop at all. Under those conditions the docking line is simply wrapped around a cleat such as 4 on the vessel for docking. Otherwise a loop could simply be tied at that end if desired or use by wrapping, either being equally effective.

The spring actuated retraction reel or weighted tension assembly of those embodiments that use it can be designed to be removed from the piling by the simple expedient of detaching it and the docking line from the piling or fixed structure, so that the boater can to take them with him to another slip. Alternatively the reel or weighted blocks assembly, with or without docking line attached, could be furnished or rented by the marina operator and be a permanent fixture of a slip. The embodiments using bungee cords attached to the docking lines can also be moved to a different slip when desired by the simple expedient of detaching the docking line, should the bungee cords be solely attached to it, or by unfastening both the bungee cord and docking line from the piling, and moving both to a new location.

Though the illustrations generally describe the embodiments' use on slips or docks that are rigidly fixed to pilings the device could as well be installed to operate on a floating dock. If necessary this may be facilitated by the simple expedient of mounting the spring-actuated reel or weighted blocks assemblies or the bungee cord attachment on a spacer with respect to the piling or fixed structure, which would prevent any docking line half-looks from getting pinched between floating dock and piling as the water level rises. However, depending on the dimensions of the retraction means such a spacer may not be needed if the loops and end of the docking line fall clear of the gap between the floating dock and the piling. These embodiments could also be used on floating or anchored moorings. Furthermore, while these embodiments are aimed at recreational boaters operating either power or sail vessels, it clearly has broader uses for marine mooring and docking of vessels of larger sizes, and other uses as well for which the simplicity of attaching and detaching a movable to a fixed object in one simple automatic operation would prove advantageous.

While shown principally as part of the first alternate embodiment, the water drag disc or discs may be used on all embodiments, and would have the additional benefit of functioning as rodent shields similar to those used on commercial vessels. Throughout several of the embodiments the retraction reel assembly may also be referred to a simply the reel assembly, and both may be used interchangeably without prejudice. Similarly the attach fitting assemblies that are used on the docking lines in some embodiments may also be referred to as attach fittings interchangeably, and without prejudice. The reel assembly and internal parts, as well as any bearings and the spring system, the housing, and indeed most parts of the spring actuated reel embodiments; and the blocks, pulleys and other parts of the weighted blocks embodiments, are envisioned to preferably be made of non-rusting materials though that is not necessary for their functioning and it is an economics decision whether to make them non-rusting and more expensive, or rust-prone but cheaper and periodically replaced. The bungee cords should be long lasting if their outer surfaces are made substantially resistant to the effects of sunlight.

While the description and operation sections of the embodiments contain many details and specifics, these should not be construed as limiting the scope of the embodiments, but as merely providing illustrations of several possible embodiments. Thus the scope of the embodiments should be determined by the appended claims and their legal equivalents, rather than by the examples given.

What I claim is:

1. An apparatus for connecting an aquatic vessel to a fixed structure over water, the apparatus comprising:

a. a docking line connected to said fixed structure b. a retrieval line communicating with said docking line c. in combination first means for urging retraction, storage proximal to said fixed structure, and permit extension of said retrieval line, said first means being attached to said fixed structure d. in combination second means for attaching said retrieval line to said docking line, and restraining said docking line thereby preventing jams and kinks from forming in said docking line during retraction of said first means, said second means being attached to said docking line and slidably communicating with said retrieval line at a plurality of locations on said docking line whereby enabling orderly retraction and extension of said docking line, and whereby when retracted said docking line remains proximal to said fixed structure and out of said water and ready for extension for subsequent docking of said vessel; and whereby docking and undocking said vessel each require only one manual operation and whereby only two manual operations are required to accomplish a complete undocking and docking cycle regardless of the sequence in which performed.

2. The apparatus of claim 1 wherein said first means comprises a reel capable of rotational motion about an axis, a retrieval line communicating with said reel, and a spring to generate an urging force on said retrieval line.

3. The apparatus of claim 1 wherein said first means comprises a reel capable of rotational motion about an axis, a retrieval line communicating with said reel, and a spring to generate an urging force on said retrieval line, and wherein said second means comprises a plurality of fittings affixed to said docking line at a plurality of locations along said docking line, the number of fittings being equal to or greater than the extended length of the docking line divided by the desired height of said first means above the water, said fittings being attached to said docking line at a plurality of locations on said docking line and slidably communicating with said retrieval line at a plurality of locations on said docking line, said fittings permitting slidable movement between said retrieval line and said docking line and retrieval and subsequent extension of said docking line.

4. The apparatus of claim 1 wherein said first means comprises a reel capable of rotational motion about an axis, a retrieval line communicating with said reel, and a spring to generate an urging force on said retrieval line and a. wherein said second means comprises a plurality of fittings affixed to said docking line at a plurality of locations along said docking line, the number of fittings being equal to or greater than the extended length of the docking line divided by the desired height of said first means above the water, said fittings being attached to said docking line at a plurality of locations on said docking line and slidably communicating with said retrieval line at a plurality of locations on said retrieval line, said fittings permitting slidable movement between said retrieval line and said docking line, and retrieval and subsequent extension of said docking line, and b. wherein a plurality of said affixed fittings comprise channels which permit slidable movement between said docking line and said retrieval line, said channels having openings larger at their periphery than in their interior so as to prevent said affixed fittings interfering with movement of said retrieval line when said retrieval line is at an angle to said affixed fittings.

5. The apparatus of claim 1 wherein said first means comprises a reel capable of rotational motion about an axis, a retrieval line communicating with said reel, and a spring to generate an urging force on said retrieval line and a. wherein said second means comprises a plurality of fittings affixed to said docking line at a plurality of locations along said docking line, the number of fittings being equal to or greater than the extended length of the docking line divided by the desired height of said first means above the water, said fittings being attached to said docking line at a plurality of locations on said docking line and slidably communicating with said retrieval line at a plurality of locations on said retrieval line, said fittings permitting slidable movement between said retrieval line and said docking line and retrieval and subsequent extension of said docking line, and b. wherein a plurality of said affixed fittings comprise channels which permit slidable movement between said docking line and said retrieval line, said channels having openings larger at their periphery than in their interior so as to prevent said affixed fittings interfering with movement of said retrieval line when said retrieval line is at an angle to said affixed fittings, and c. wherein said affixed fittings further comprise, in combination, third means for adjustably imparting friction to said retrieval line and thereby controlled urging to said docking line to facilitate orderly retrieval of said docking line.

6. The apparatus of claim 1 wherein said first means comprises a reel capable of rotational motion about an axis, a retrieval line communicating with said reel, and a spring to generate an urging force on said retrieval line, and a. wherein said second means comprises a plurality of fittings each comprising an opening affixed to said docking line at a plurality of locations along said docking line, the number of fittings being equal to or greater than the extended length of the docking line divided by the desired height of said first means above the water, said fittings being attached to said docking line at a plurality of locations on said docking line and slidably communicating with said retrieval line at a plurality of locations on said docking line, said fittings permitting slidable movement between said retrieval line and said docking line and retrieval and subsequent extension of said docking line, and b. wherein said second means also comprises at least one disc or other object which is larger than the opening of said fittings and which is connected to said docking line to generate hydrodynamic drag forces when said docking line is moving through the water urged by the retrieval line.

7. The apparatus of claim 1 wherein said first means comprises blocks and pulleys operated by weights, and a retrieval line communicating with said docking line.

8. The apparatus of claim 1 wherein said first means comprises a. blocks and pulleys operated by weights, and a retrieval line communicating with said docking line, b. wherein said second means comprises a plurality of fittings affixed to said docking line at a plurality of locations along said docking line, the number of fittings being equal to or greater than the extended length of the docking line divided by the desired height of said first means above the water, said fittings being attached to said docking line at a plurality of locations on said docking line and slidably communicating with said retrieval line at a plurality of locations on said docking line, said fittings permitting slidable movement between said retrieval line and said docking line and retrieval and subsequent extension of said docking line, and c. wherein said second means comprises a plurality of fittings affixed to said docking line at a plurality of locations along said docking line, the number of fittings being equal to or greater than the extended length of the docking line divided by the desired height of said first means above the water said fittings being attached to said docking line at a plurality of locations on said docking line and slidably communicating with said retrieval line at a plurality of locations on said docking line, permitting slidable movement between said retrieval line and said docking line and retrieval and subsequent extension of said docking line.

9. The apparatus of claim 1 wherein said first means comprises:

a. blocks and pulleys operated by weights, and a retrieval line communicating with said docking line, and b. wherein said second means comprises a plurality of fittings affixed to said docking line at a plurality of locations along said docking line, the number of fittings being equal to or greater than the extended length of the docking line divided by the desired height of said first means above the water, said fittings being attached to said docking line at a plurality of locations and slidably communicating with said retrieving line at a plurality of locations, said fittings permitting slidable movement between said retrieval line and said docking line and retrieval and subsequent extension of said docking line, and c. wherein at least one of said affixed fittings comprise channels which permit slidable movement between said docking line and said retrieval line, said channels having openings larger at their periphery than in their interior so as to prevent said affixed fittings interfering with movement of said retrieval line when said retrieval line is at an angle to said affixed fittings.

10. The apparatus of claim 1 wherein said first means comprises a. blocks and pulleys operated by weights, and a retrieval line communicating with said docking line, and b. wherein said second means comprises a plurality of fittings affixed to said docking line at a plurality of locations along said docking line, the number of fittings being equal to or greater than the extended length of the docking line divided by the desired height of said first means above the water, said fittings being attached to said docking line at a plurality of locations on said docking line and slidably communicating with said retrieval line at a plurality of locations, said fittings permitting slidable movement between said docking line and said retrieval line, and retrieval and subsequent extension of said docking line c. wherein said affixed fittings comprise channels which permit slidable movement between said docking line and said retrieval line, said channels having openings larger at their periphery than in their interior so as to prevent said affixed fittings interfering with movement of said retrieval line when said retrieval line is at an angle to said affixed fittings, and d. wherein said affixed fittings further comprise, in combination, third means for adjustably imparting friction to said retrieval line and thereby controlled urging to said docking line to facilitate orderly retrieval of said docking line.

11. The apparatus of claim 1 wherein said first means comprises:

a. blocks and pulleys operated by weights, and a retrieval line communicating with said docking line, and b. wherein said second means comprises a plurality of fittings comprising an opening, affixed to said docking line at a plurality of locations along said docking line, the number of fittings being equal to or greater than the extended length of the docking line divided by the desired height of said first means above the water, said fittings slidably communicating with said retrieving line at a plurality of locations, said fittings permitting slidable movement between said retrieval line and said docking line and retrieval and subsequent extension of said docking line, and c. wherein said second means also comprises at least one disc or other object which is larger than the opening of said fittings and which is connected to said docking line to generate hydrodynamic drag forces when said docking line is moving through the water urged by the retrieval line.

12. An apparatus for connecting an aquatic vessel to a fixed structure over water, the apparatus comprising:

a. a docking line connected to said fixed structure b. an elastic cord connected to said docking line at a plurality of locations along said docking line including at or near the ends of said docking line to urge retraction store, and permit extension of said docking line, and said elastic cord is connected directly to said docking line at said locations so that said elastic cord and said docking line are of equal length and are parallel and close to each other throughout their lengths when said elastic cord is fully extended, whereby when retracted said docking line remains proximal to said fixed structure and out of said water and ready for the subsequent docking operation, and whereby the docking and undocking of said vessel each require only one manual operation and whereby only two manual operations are required to accomplish a complete undocking and docking cycle regardless of the sequence in which performed.

13. The apparatus of claim 12 wherein said elastic cord comprises a single continuous member.

14. The apparatus of claim 12 wherein said elastic cord comprises a single continuous member and wherein said locations comprise fittings affixed to said docking line by compression, and the ratio of the fully extended length of the total elastic cord to the fully relaxed length of said elastic cord is equal to the ratio of the fully extended length of the docking line to the desired height above the water of the said attachment means of said docking line to said fixed structure.

15. The apparatus of claim 12 wherein said elastic cord comprises a single continuous member and said locations comprise ligatures affixed to said docking line, and the ratio of the fully extended length of the total elastic cord to the fully relaxed length of said elastic cord is equal to the ratio of the fully extended length of the docking line to the desired height above the water of the said attachment means of said docking line to said fixed structure.

16. The apparatus of claim 12 wherein said elastic cord is comprised of a plurality of members.

17. The apparatus of claim 12 wherein said elastic cord is comprised of a plurality of members and said locations comprise fittings affixed to said docking line by compression, and the ratio of the fully extended length of the total elastic cord to the fully relaxed length of said elastic cord is equal to the ratio of the fully extended length of the docking line to the desired height above the water of the said attachment means of said docking line to said fixed structure.

18. The apparatus of claim 12 wherein said elastic cord is comprised of a plurality of members and said locations comprise ligatures affixed to said docking line, and the ratio of the fully extended length of the total elastic cord to the fully relaxed length of said elastic cord is equal to the ratio of the fully extended length of the docking line to the desired height above the water of the said attachment means of said docking line to said fixed structure.

19. The apparatus of claim 12 wherein said elastic cord comprises a single continuous member and—said locations comprise a thermosetting polymer permeating said docking line for attachment to said elastic cord, and the ratio of the fully extended length of the total elastic cord to the fully relaxed length of said elastic cord is equal to the ratio of the fully extended length of the docking line to the desired height above the water of the said attachment means of said docking line to said fixed structure.

20. A method for connecting an aquatic vessel to a fixed structure over water, comprising:

a. providing a docking line communicating with said fixed structure b. providing a retrieval line attached to said docking line and slidably communicating with said docking line at a plurality of locations, and in combination means for urging retraction of said retrieval line, and storage of said docking line proximal to said fixed structure and out of said water, and in position to permit subsequent extension of said docking line without requiring any intervening manual operations c. providing in combination means for restraining movements of said docking line with said retrieval line attached comprising a plurality of fittings each comprising an opening slidably connected to said retrieval line, and an additional disc or other object larger than said fittings affixed to said docking line to generate drag forces when said docking line moves through the water urged by said retrieval line, resulting in orderly retraction and extension of said docking line and avoiding snags and kinks and jams d. grasping the end of said docking line when attached to said vessel, detaching and abandoning said docking line during undocking, thereby initiating refraction and storage of said docking line proximal to said fixed structure and out of said water using only one manual operation, whereby said docking line with said retrieval line attached is in position and ready for a docking operation e. Grasping or grappling the end of said docking line when stored proximal to said fixed structure during docking, extending said docking line with said retrieval line communicating with said docking line, and attaching said docking line to said vessel using only one manual operation whereby the method resulting in orderly and stable retraction and storage of said docking line proximal to the said fixed structure when undocking, keeping said docking line out of the water and in position ready for the next docking operation; and facilitating the grasping, extension, and attachment of said docking line to said vessel when docking, all resulting in easy, safe, and anxiety-free undocking and docking of aquatic vessels and requiring only seconds to accomplish either docking or undocking; and whereby docking and undocking said vessel each require only one manual operation, and whereby only two manual operations are required to accomplish a complete undocking and docking cycle regardless of the sequence in which performed; and providing continuous urgings while docked to keep vessel substantially centered in a slip or held against a dock.

* * * * *